US011225765B2

(12) United States Patent
Aubin-Marchand et al.

(10) Patent No.: US 11,225,765 B2
(45) **Date of Patent: *Jan. 18, 2022**

(54) FRAME ASSEMBLY FOR SUPPORTING AN IMPLEMENT ON A VEHICLE

(71) Applicant: SOUCY INTERNATIONAL INC., Drummondville (CA)

(72) Inventors: Jeremie Aubin-Marchand, St-Hugues (CA); Karen Provencher, Drummondville (CA); Normand Roy, St-Hugues (CA); Michael Bergeron, Drummondville (CA); Yan Roger, Drummondville (CA)

(73) Assignee: SOUCY INTERNATIONAL INC., Drummondville (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/792,639

(22) Filed: Feb. 17, 2020

(65) Prior Publication Data

US 2020/0181861 A1 Jun. 11, 2020

Related U.S. Application Data

(63) Continuation of application No. 15/840,773, filed on Dec. 13, 2017, now Pat. No. 10,604,902.

(60) Provisional application No. 62/433,694, filed on Dec. 13, 2016.

(51) Int. Cl.

| | |
|---|---|
| ***E01H 5/06*** | (2006.01) |
| ***E02F 3/815*** | (2006.01) |
| ***E02F 3/76*** | (2006.01) |
| *E02F 9/08* | (2006.01) |

(52) U.S. Cl.

CPC ..... *E01H 5/062* (2013.01); *E01H 5/06* (2013.01); *E02F 3/7622* (2013.01); *E02F 3/7645* (2013.01); *E02F 3/8157* (2013.01); *E02F 9/0808* (2013.01)

(58) Field of Classification Search

CPC ..... E02F 3/7645; E02F 3/8157; E02F 3/7622; E01H 5/062; E01H 5/06

See application file for complete search history.

(56) References Cited

U.S. PATENT DOCUMENTS

| | | | |
|---|---|---|---|
| 3,815,687 | A | 6/1974 | Federspiel |
| 3,828,449 | A | 8/1974 | Miceli |
| 3,883,965 | A | 5/1975 | Poirier et al. |
| 4,528,762 | A | 7/1985 | Sarka et al. |

(Continued)

*Primary Examiner* — Jessica H Lutz

(74) *Attorney, Agent, or Firm* — BCF LLP

(57) ABSTRACT

A frame assembly for supporting an implement on a vehicle includes a support frame attachable to the vehicle, a lever pivotable about a first axis between first and second positions, and a biasing assembly connecting the lever to the support frame. A first end of the biasing assembly is supported against the lever to pivot about a second pivot axis being parallel to the first pivot axis and being vertically spaced relative to the first pivot axis when the support frame is removably attached to the vehicle and the lever is in the first position. A second end of the biasing assembly is supported against the support frame to pivot about a third pivot axis when the lever pivots about the first pivot axis. The third pivot axis is parallel to and is spaced from the first pivot axis when the support frame is removably attached to the vehicle.

17 Claims, 14 Drawing Sheets

(56) References Cited

U.S. PATENT DOCUMENTS 4,570,367 A 2/1986 Oya
4,658,519 A * 4/1987 Quenzi ..... E01H 5/063 172/272
4,825,570 A * 5/1989 Schmid ..... A01B 63/04 172/817
5,075,988 A 12/1991 Ciula
5,088,215 A * 2/1992 Ciula ..... E01H 5/063 264/279.1
6,178,669 B1 * 1/2001 Quenzi ..... E01H 5/06 172/275
6,393,737 B2 5/2002 Quenzi et al.
6,408,547 B1 6/2002 Jones et al.
6,526,677 B1 3/2003 Bloxdorf et al.
6,860,040 B2 3/2005 Schultz et al.
7,143,531 B2 12/2006 Micozzi
7,334,357 B1 2/2008 Altheide
7,735,247 B2 6/2010 Schmeichel
8,763,280 B1 7/2014 Fournier et al.
9,051,700 B2 6/2015 Summers et al.
9,145,096 B2 9/2015 Werthauser
9,255,371 B1 2/2016 Jordan
9,869,067 B2 1/2018 Barker et al.
2001/0047600 A1 * 12/2001 Quenzi ..... E01H 5/06 37/270
2005/0246925 A1 * 11/2005 Raddon ..... E01H 5/06 37/266
2010/0025058 A1 2/2010 Carter
2012/0187263 A1 * 7/2012 Coulombe ..... E02F 3/627 248/205.1
2013/0232827 A1 * 9/2013 Summers ..... E01H 5/062 37/232
2014/0262372 A1 * 9/2014 Taunton ..... A01B 63/008 172/239
2017/0284045 A1 10/2017 Holman
2020/0217030 A1 * 7/2020 Briggs ..... E01H 5/063

* cited by examiner

FRAME ASSEMBLY FOR SUPPORTING AN IMPLEMENT ON A VEHICLE

CROSS-REFERENCE

The present application is a Continuation application of U.S. patent application Ser. No. 15/840,773, filed Dec. 13, 2017, entitled "Frame assembly for supporting an implement on a vehicle". Through the U.S. patent application Ser. No. 15/840,773, the present application claims priority to U.S. Provisional Patent Application No. 62/433,694 filed Dec. 13, 2016, entitled "Impact Reduction System for Frame Assemblies and Method of Using the Same". All of the above-mentioned patent applications are incorporated by reference herein in their entirety.

TECHNICAL FIELD

The present technology relates to frame assemblies for supporting implements on vehicles.

BACKGROUND

All-terrain vehicles (ATV), utility-terrain vehicles (UTVs), and other similar vehicles, are often equipped with implements such as (snow) plows to allow the vehicles to displace snow, dirt, soil, gravel, etc. In general, such implements are removably mounted to the vehicles via supporting frames. In some cases, such supporting frames have shock absorption mechanisms to absorb some of the impacts that may be sustained by implements during use. Such existing arrangements are suitable for their intended purposes, but have some disadvantages in at least some applications.

For example, in some applications, some existing supporting frames orient an implement relative to ground upon which a vehicle operates such that in some use conditions, the implement tends to be driven into the ground. As another example, at least some existing supporting frames that have a shock absorption mechanism require a given amount of space to provide a given amount of shock absorption, which amount of space is relatively large and makes it inconvenient or otherwise difficult to install onto some vehicles. In some cases, the ratio of the amount of space required per unit of shock absorption for at least some existing supporting frames that have a shock absorption mechanism results in such existing systems providing sub-optimal amounts of shock absorption when scaled down to be used on some smaller vehicles, such as ATVs.

SUMMARY

It is an object of the present technology to ameliorate at least some of the inconveniences present in the prior art.

According to one aspect of the present technology, there is provided a frame assembly for supporting an implement on a vehicle, comprising: a) a support frame being structured to removably attach to the vehicle; b) a lever being pivotably connected to the support frame to pivot about a first pivot axis between a first position and a second position, the lever including, i) a first attachment portion, and ii) a second attachment portion, the second attachment portion being structured to connect to the implement to support the implement on the second attachment portion; and c) a biasing assembly having a first end and a second end, the first end and the second end defining a length of the biasing assembly.

In some implementations, the biasing assembly is movable between an extended position and a compressed position, the length of the biasing assembly being greater in the extended position than in the compressed position, the biasing assembly being biased from the compressed position toward the extended position. The first end of the biasing assembly is supported against the first attachment portion to pivot about a second pivot axis.

In some implementations, the second pivot axis is parallel to the first pivot axis and is at a lower elevation than the first pivot axis when the support frame is removably attached to the vehicle and the first attachment portion is in the first position. The second end of the biasing assembly is supported against the support frame to pivot about a third pivot axis when the first attachment portion pivots about the first pivot axis. In some implementations, the third pivot axis is parallel to the first pivot axis and is rearward of the first pivot axis when the support frame is removably attached to the vehicle.

In some implementations: i) the first attachment portion is in the first position when the biasing assembly is in the extended position; ii) the first attachment portion is in the second position when the biasing assembly is in the compressed position; iii) the first pivot axis and the second pivot axis define a first plane; iv) the second pivot axis and the third pivot axis define a second plane; v) the first and second planes define an angle therebetween; and vi) the angle is acute and opens toward the vehicle when the support frame is removably attached to the vehicle and the first attachment portion is in the first position.

In some implementations, the second pivot axis is at a higher elevation than the third pivot axis when the support frame is removably attached to the vehicle and the first attachment portion is in the first position.

In some implementations, the second pivot axis is forward of the first pivot axis when the support frame is removably attached to the vehicle and the first attachment portion is in the first position.

In some implementations, the angle is acute when the biasing assembly is in the compressed position.

In some implementations, the compressed position defines a compression limit of the biasing assembly.

In some implementations, a) the compressed position is a first compressed position; b) the biasing assembly is movable to a second compressed position in which the length of the biasing assembly is smaller than in the first compressed position; c) the first attachment portion is pivotable about the first pivot axis from the second position to a third position that is rearward of the second position; d) the biasing assembly is in the second compressed position when the first attachment portion is in the third position; e) the biasing assembly is biased from the second compressed position toward the first compressed position; and f) the angle is obtuse and opens toward the vehicle when the support frame is removably attached to the vehicle and the first attachment portion is in the third position.

In some implementations, the second compressed position defines a compression limit of the biasing assembly.

In some implementations: a) the first attachment portion is spaced from the first pivot axis by a first distance, the first distance being measured normal to the first pivot axis; b) the second attachment portion is spaced from the first pivot axis by a second distance, the second distance being measured normal to the first pivot axis; and c) the second distance is larger than the first distance.

In some implementations, the second attachment portion is at a lower elevation than the first attachment portion when the support frame is removably attached to the vehicle and the first attachment portion is in the first position.

In some implementations, the second attachment portion is rearward of the first attachment portion when the support frame is removably attached to the vehicle and the first attachment portion is in the first position.

In some implementations, the second attachment portion is structured to connect to the implement to pivotably support the implement on the second attachment portion about a fourth pivot axis, the fourth pivot axis being parallel to the first pivot axis.

In some implementations, the fourth pivot axis is at a lower elevation than the second pivot axis when the support frame is removably attached to the vehicle and the first attachment portion is in the first position.

In some implementations, the fourth pivot axis is rearward of the second pivot axis when the support frame is removably attached to the vehicle and the first attachment portion is in the first position.

In some implementations, the lever is dimensioned and shaped such that when, a) the second attachment portion is connected to the implement, b) the first attachment portion is in the first position, and c) the implement applies a rearward force to the second attachment portion, the first end of the biasing assembly pivots downward relative to the third pivot axis.

In some implementations, the biasing assembly includes a spring extending between the first and second ends of the biasing assembly.

In some implementations, the spring is a first spring, and the biasing assembly includes a second spring extending between the first and second ends of the biasing assembly.

In some implementations, the frame assembly includes a limiting member defined by a u-shaped structure having two ends, and wherein: a) the first end of the biasing assembly is connected to the first attachment portion to pivot about the second pivot axis; b) the two ends of the u-shaped structure are connected to the first end of the biasing assembly; c) the u-shaped structure slidably straddles the second end of the biasing assembly and defines an aperture between the second end of the biasing assembly and the u-shaped structure; d) the support frame includes a frame member that is positioned transversely relative to the vehicle when the support frame is removably attached to the vehicle; e) the frame member is received through the aperture; f) the extended position of the biasing assembly is a first extended position; g) the biasing assembly is movable to a second extended position when the biasing assembly is removed from the frame assembly, the length of the biasing assembly being greater than in the second extended position than in the first extended position; and h) a length of the limiting member is selected such that the u-shaped structure contacts the frame member of the support frame when the biasing assembly is in the extended position and thereby prevents the biasing assembly from moving from the first extended position toward the second extended position.

In some implementations, the frame assembly includes a limiting member defined by a u-shaped structure having two ends, and wherein: a) the second end of the biasing assembly is connected to the support frame to pivot about the third pivot axis; b) the two ends of the u-shaped structure are connected to the second end of the biasing assembly; c) the u-shaped structure slidably straddles the first end of the biasing assembly and defines an aperture between the first end of the biasing assembly and the u-shaped structure; d) the first attachment portion includes a frame member that is positioned transversely relative to the vehicle when the support frame is removably attached to the vehicle; e) the frame member is received through the aperture; f) the extended position of the biasing assembly is a first extended position; g) the biasing assembly is movable to a second extended position when the biasing assembly is removed from the frame assembly, the length of the biasing assembly being greater than in the second extended position than in the first extended position; and h) a length of the limiting member is selected such that the u-shaped structure contacts the frame member of the first attachment portion when the biasing assembly is in the extended position and thereby prevents the biasing assembly from moving from the first extended position toward the second extended position.

In some implementations, the length of the limiting member is selectively adjustable to thereby adjust a location of the first position of the first attachment portion relative to the support frame.

In some implementations, the support frame includes: a) a receiving member defining a cavity therein, the cavity being open on a top side of the receiving member and being sized to releasably receive a rod of the vehicle therein via the top side of the receiving member; and b) a retaining member movable relative to the receiving member between an unlocked position in which the retaining member does not obstruct the cavity and thereby allows the rod to be received in the cavity, and a locked position in which the retaining member obstructs the cavity on the top side of the receiving member and thereby prevents the rod from exiting the cavity via the top side of the receiving member after the rod has been received in the cavity, the retaining member being biased from the unlocked position to the locked position.

For purposes of this application, terms related to spatial orientation such as forward, rearward, upward, downward, left, and right, when used in relation to a vehicle should be understood in a frame of reference of a driver driving the vehicle. Terms related to spatial orientation when describing or referring to components or sub-assemblies or other parts that are removably or otherwise attached, or are removably attachable to the vehicle, should be understood as they would be understood when these components or sub-assemblies or other parts are attached, removably or otherwise, to the vehicle, unless specified otherwise in this application.

For the purposes of this document, the term "resting position" when used with regard to a spring refers to the position that the spring takes when no compression and no restriction of movement is applied to the spring.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Should there be any difference in the definitions of term in this application and the definition of these terms in any document included herein by reference, the terms as defined in the present application take precedence.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

In accordance with an aspect of the present technology and with reference to the accompanying FIGS. 1 to 14, snow plow frame 103 and frame assembly 136 according to an implementation of the present technology will be described. It should be understood that the snow plow frame 103 and the and frame assembly 136 are merely an embodiment of the present technology. Thus, the description thereof that follows is intended to be only a description of illustrative examples of the present technology. This description is not intended to define the scope or set forth the bounds of the present technology.

Examples of modifications or alternatives to the snow plow frame 103 and the frame assembly 136 are described below. This is done merely as an aid to understanding, and, again, not to define the scope or set forth the bounds of the present technology. These modifications are not an exhaustive list, and, as a person skilled in the art would understand, other modifications are likely possible.

Further, where this has not been done (i.e. where no examples of modifications have been set forth), it should not be interpreted that no modifications are possible and/or that what is described is the sole manner of implementing or embodying that element of the present technology.

In addition, it is to be understood that the snow plow frame 103 and the frame assembly 136 may provide in certain aspects a simple implementation of the present technology, and that where such is the case it has been presented in this manner as an aid to understanding. As persons skilled in the art would understand, various implementations of the present technology may be of a greater complexity than what is described herein.

The present technology is illustrated with respect to an ATV 100, for supporting a snow plow 101 that is pivotably mounted to a snow plow frame 103, on the ATV 100. As will be described in more detail herein below, the present technology is engineered to move under at least some forces that may be applied to the snow plow 101 when the snow plow 101 is in use, as a result of the snow plow 101 being hit against an obstacle, for example. The snow plow 101 is an example of an implement and the snow plow frame 103 is an example of an implement support frame. It is contemplated that the present technology could be used to support other snow plows and/or other implements via the snow plow frame 103 (or other type of frame) on the ATV 100. It is also contemplated that the present technology could be used to support an implement on other vehicles. For example, it is contemplated that the present technology could also be used to support an implement on other vehicles of similar construction, such as a side-by-side vehicle (SSV) or a utility vehicle (UTV).

Figure 1:
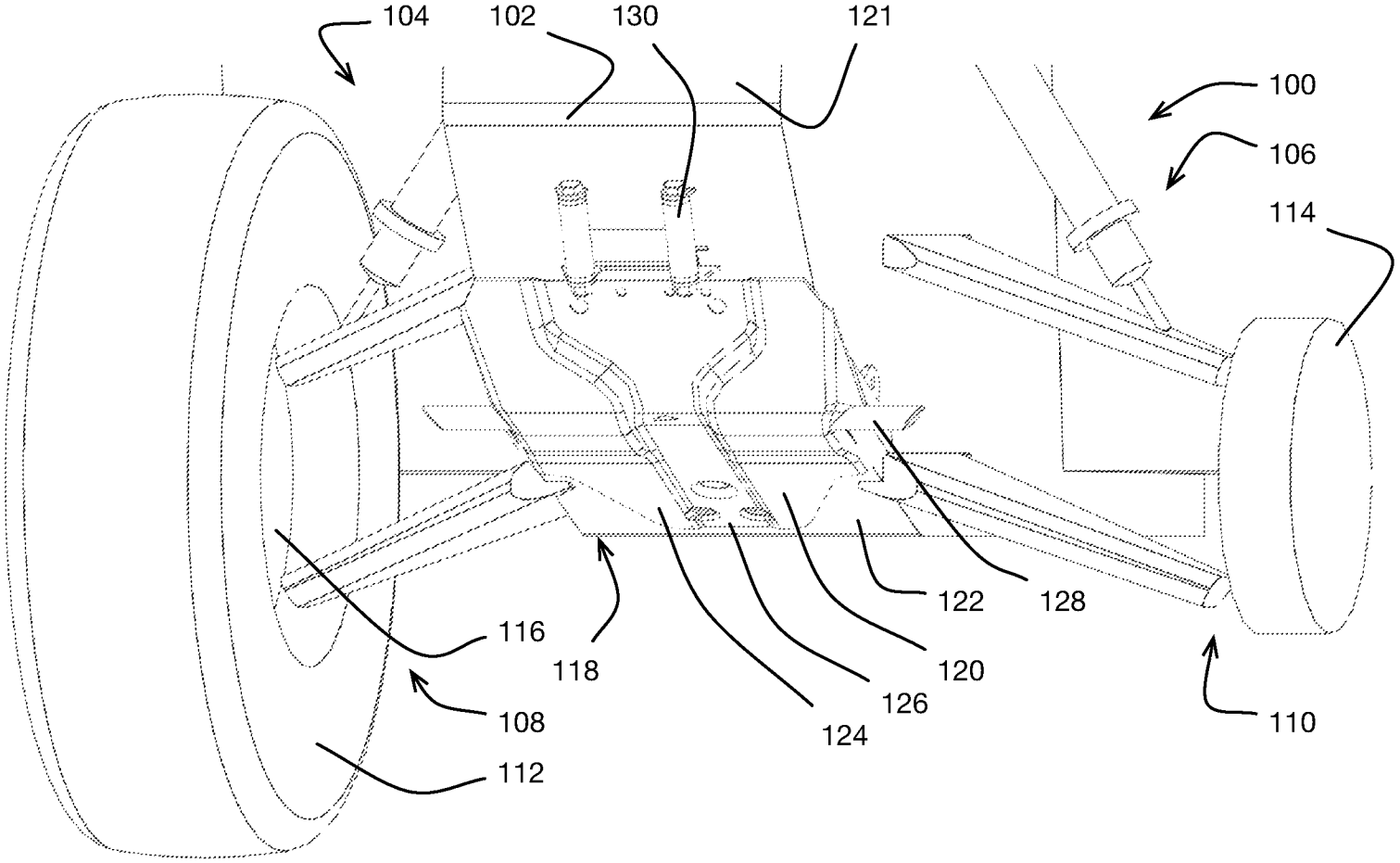
FIG. 1 is a perspective view of a part of an ATV, taken from a front left side of the ATV.

FIG. 1 shows a front portion of the ATV 100. The ATV 100 has a chassis 102, two front suspension systems 104, 106, and two front wheel assemblies 108, 110 supported on corresponding ones of the suspension systems 104, 106. Each of the two front wheel assemblies 108, 110 includes a wheel (right wheel 112 is shown) that supports the ATV 100 on terrain. The front left wheel of the ATV 100 is a mirror image of the front right wheel 112. The front left wheel is not shown in order to better show a front left wheel hub 114 of the front left wheel assembly 110. The front left wheel hub 114 supports the front left wheel thereon. The front right wheel assembly 108 has a front right wheel hub 116, which is a mirror image of the front left wheel hub 114.

It is contemplated that the ATV 100 could have any other suitable ground-engaging assemblies instead of the two front wheel assemblies 108, 110. For example, the ATV 100 could have two track kit assemblies instead of the two front wheel assemblies 108, 110. In the present implementation, the ATV 100 has two rear wheel assemblies that support the ATV 100 on terrain. The rear wheel assemblies are similar to the two front wheel assemblies 108, 110 and are not shown to maintain clarity of the present document. It is contemplated that the ATV 100 could have any other suitable ground-engaging assemblies instead of the two rear wheel assemblies. For example, the ATV 100 could have two track kit assemblies instead of the two rear wheel assemblies.

In the present implementation, the ATV 100 further includes a skid plate 118 and an receiving assembly 120 attached to the skid plate 118. The skid plate 118 is attached to the bottom of the chassis 102 and protects the chassis and other parts of the ATV 100 from impacts thereto. The receiving assembly 120 is attached to the skid plate 118 at a front, angled, portion 122 of the skid plate 118. As shown, in the present implementation, the receiving assembly 120 is sized and positioned on the front, angled, portion 122 of the skid plate 118 such that the skid plate 118 extends below the lowest point of the receiving assembly 120. In some applications, this helps avoid contact between the ATV 100 and obstacles on the ground over which the ATV 100 could be driven. It is contemplated that in some implementations, the receiving assembly 120 could extend below the bottom surface of the skid plate 118.

Also, as shown, in the present implementation, the receiving assembly 120 is sized and positioned on the chassis 102 such that the receiving assembly 120 is positioned rearward of a forwardmost point 121 on the chassis 102 and does not extend forward from under the chassis 102 or forward of the forwardmost point 121 on the chassis 102. It is contemplated that in some implementations, the receiving assembly 120 could extend forward from under the chassis 102. In the present implementation, the receiving assembly 120 includes a body 124 that has an abutment surface 126, and a rod 128 extending transversely through the body 124 such that one end of the rod 128 extends rightward out of the body 124 of the receiving assembly 120 and the other end of the rod 128 extends leftward out of the body 124 of the receiving assembly 120.

Figure 2:
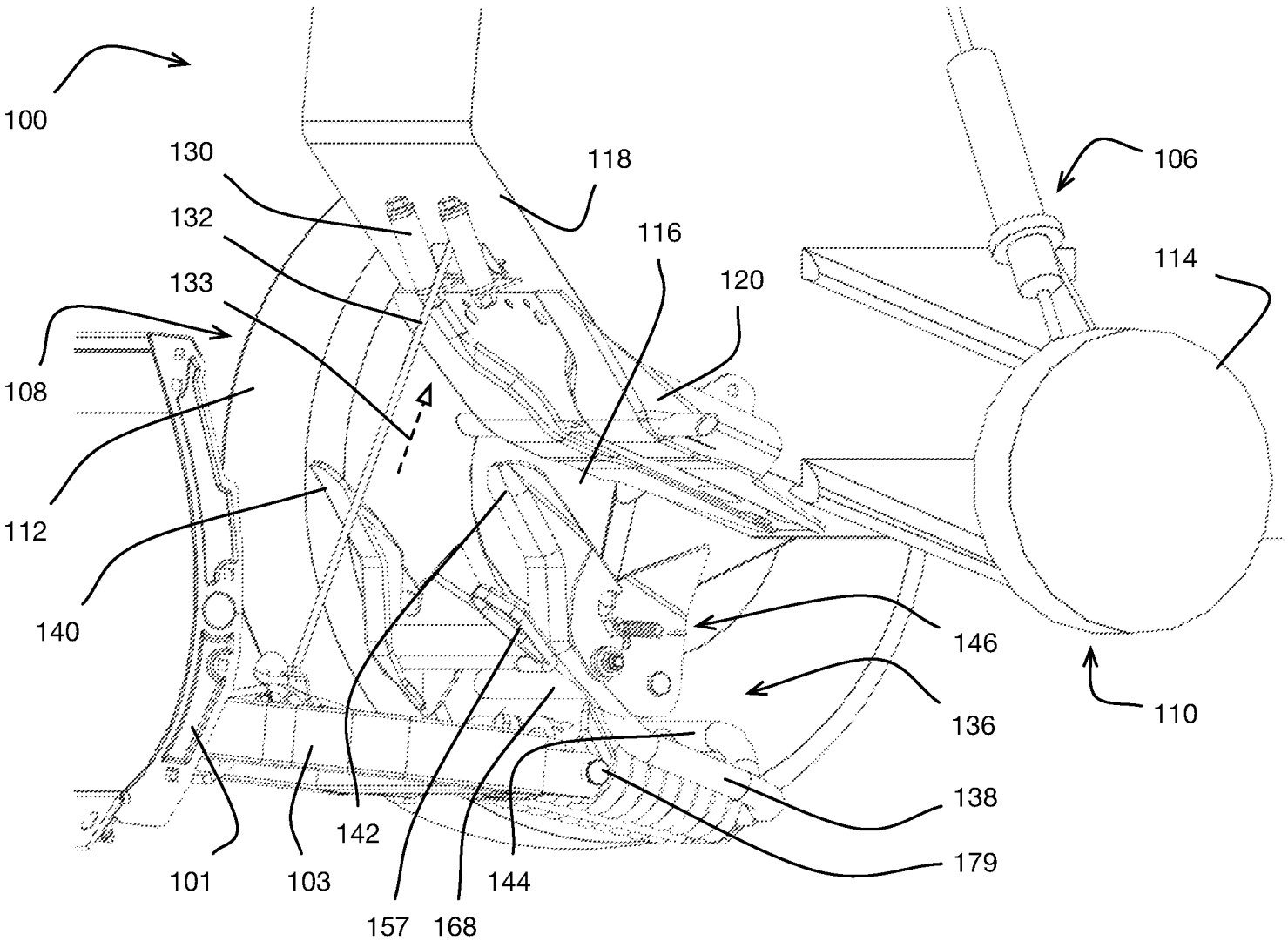
FIG. 2 is a perspective view of the part of the ATV of FIG. 1, taken from a front left side of the ATV, and a snow plow, a snow plow frame, and a frame assembly being pulled toward the ATV by a winch of the ATV.
Figure 3:
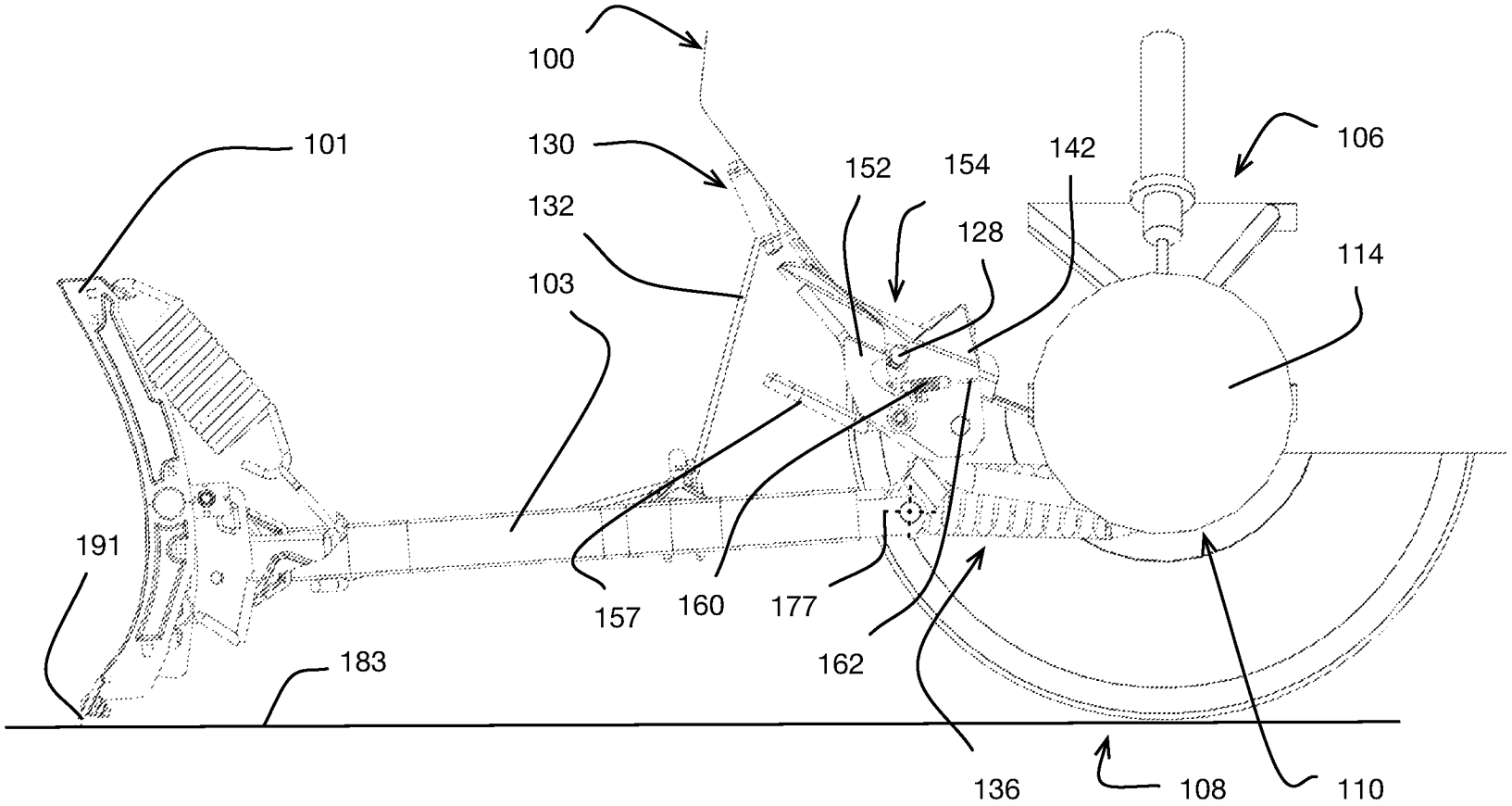
FIG. 3 is a side elevation view of the part of the ATV of FIG. 1, the frame assembly of FIG. 2 being in the process of being removably attached to a receiving assembly of the ATV.
Figure 4:
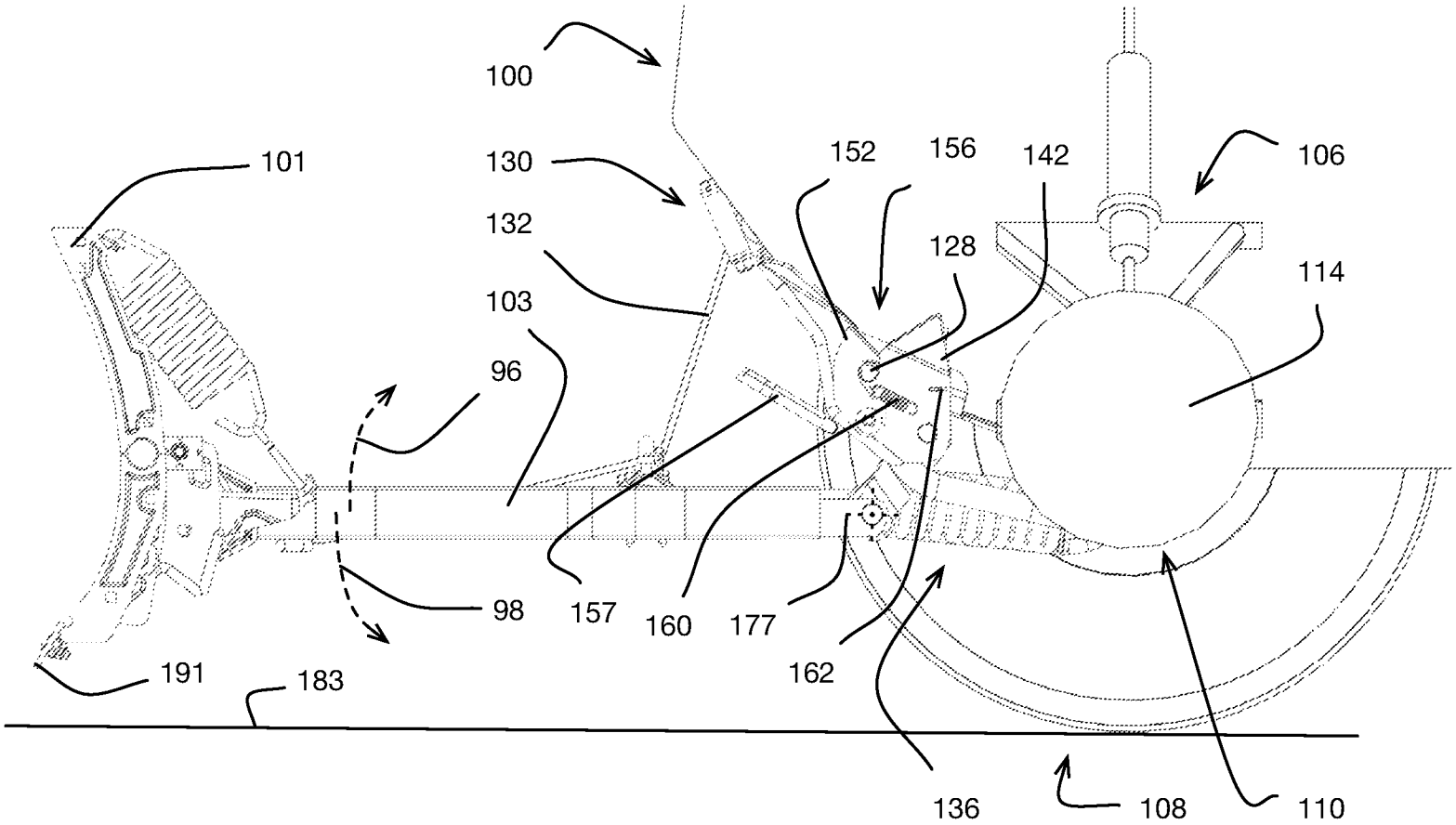
FIG. 4 is a side elevation view of the part of the ATV of FIG. 1, the frame assembly of FIG. 2 being removably attached to a receiving assembly of the ATV.

In the present implementation, the ATV 100 further includes a winch 130 supported by the chassis 102 and positioned above the receiving assembly 120. As shown in FIGS. 2 to 4, the winch 130 includes a cable 132. The cable 132 terminates at a hook. The hook connects the cable 132 to the snow plow frame 103. It is contemplated that any other connector could be used instead of or in addition to the hook to connect the cable 132 to the snow plow frame 103. The winch 130 is operable to extend and to retract the cable 132. The snow plow 101 is pivotably connected to a frame assembly 136 via the snow plow frame 103.

As shown with reference arrow 133 in FIG. 2, the winch 130 retracts the cable 132, once the cable 132 is connected to the snow plow frame 103, and thereby pulls the snow plow 101, the snow plow frame 103 and the frame assembly 136 upward until the frame assembly 136 removably attaches to the receiving assembly 120. The removable attachment of the frame assembly 136 to the receiving assembly 120 is described in more detail herein below.

Once the frame assembly 136 is removably attached to the receiving assembly 120, as shown in FIGS. 3 and 4, the winch 130 can be operated to retract the cable 132 into the winch 130 or extend the cable 132 out of the winch 130 and to thereby pivot the snow plow frame 103 up 96 or down 98 (FIG. 4) relative to an implement frame pivot axis 177 (FIGS. 3 and 4) defined at the attachment of the snow plow frame 103 to the frame assembly 136. Attachment of the snow plow frame 103 to the frame assembly 136 is described in more detail herein below. It is contemplated that a different mechanism could be used instead of or in addition to the winch 130 to mount the snow plow 101, the snow plow frame 103 and the frame assembly 136 to the ATV 100 and/or pivot the snow plow 101 and the snow plow frame 103 up 96 and down 98 relative to the implement frame pivot axis 177.

The frame assembly 136 supports the snow plow frame 103 and therefore also the snow plow 101 on the ATV 100. To this end, and as best shown in FIGS. 5 to 8, the frame assembly 136 includes a support frame 138 that is removably attached to the ATV 100 by being removably attached to the receiving assembly 120. To this end, the support frame 138 includes two receiving members 140, 142 forming a front portion of the support frame 138, a generally u-shaped frame member 143 forming a rear portion of the support frame 138, and an abutment member 144.

Figure 7:
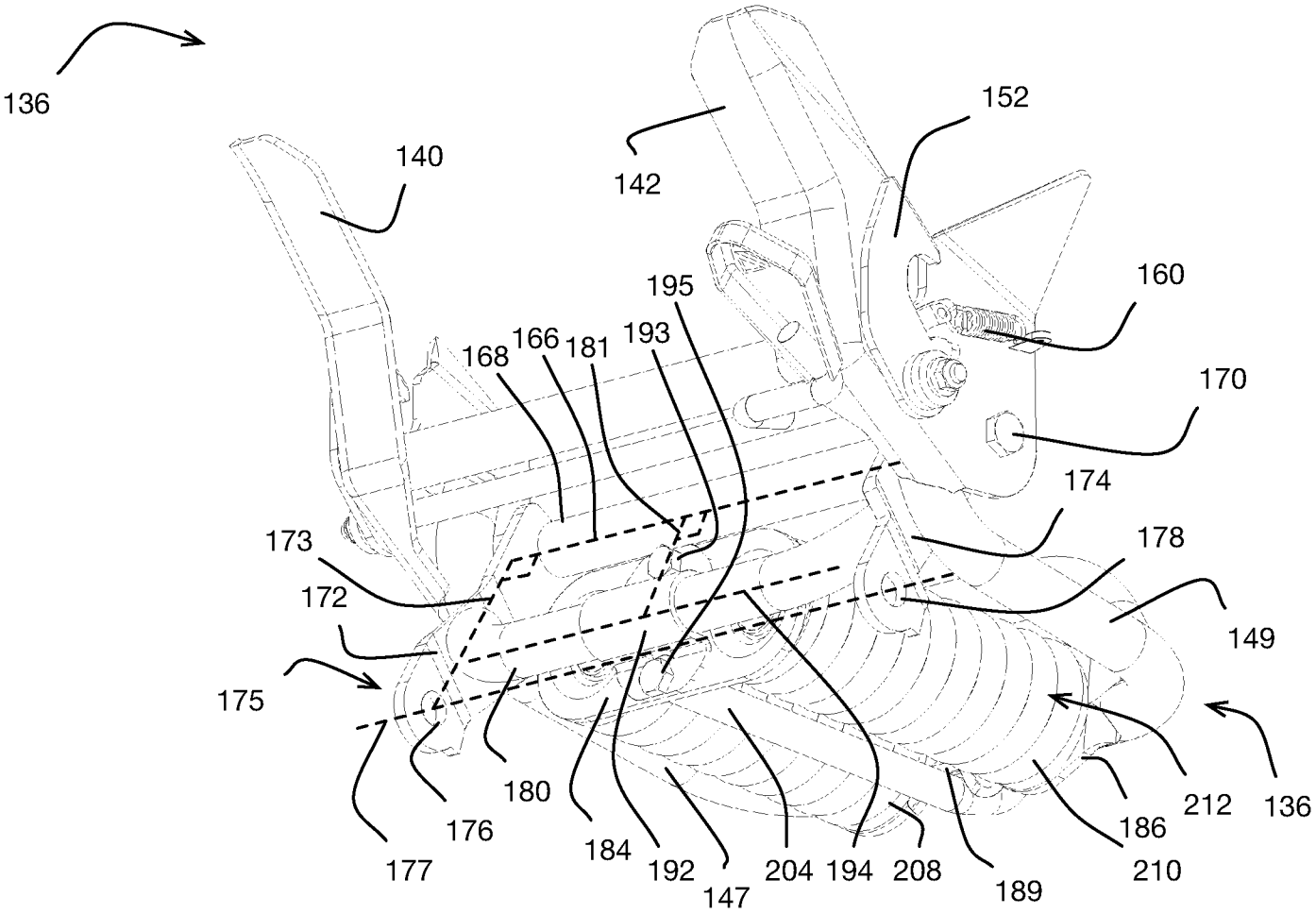
FIG. 7 is a perspective view taken from a front, bottom, left side of the frame assembly of FIG. 3.
Figure 8:
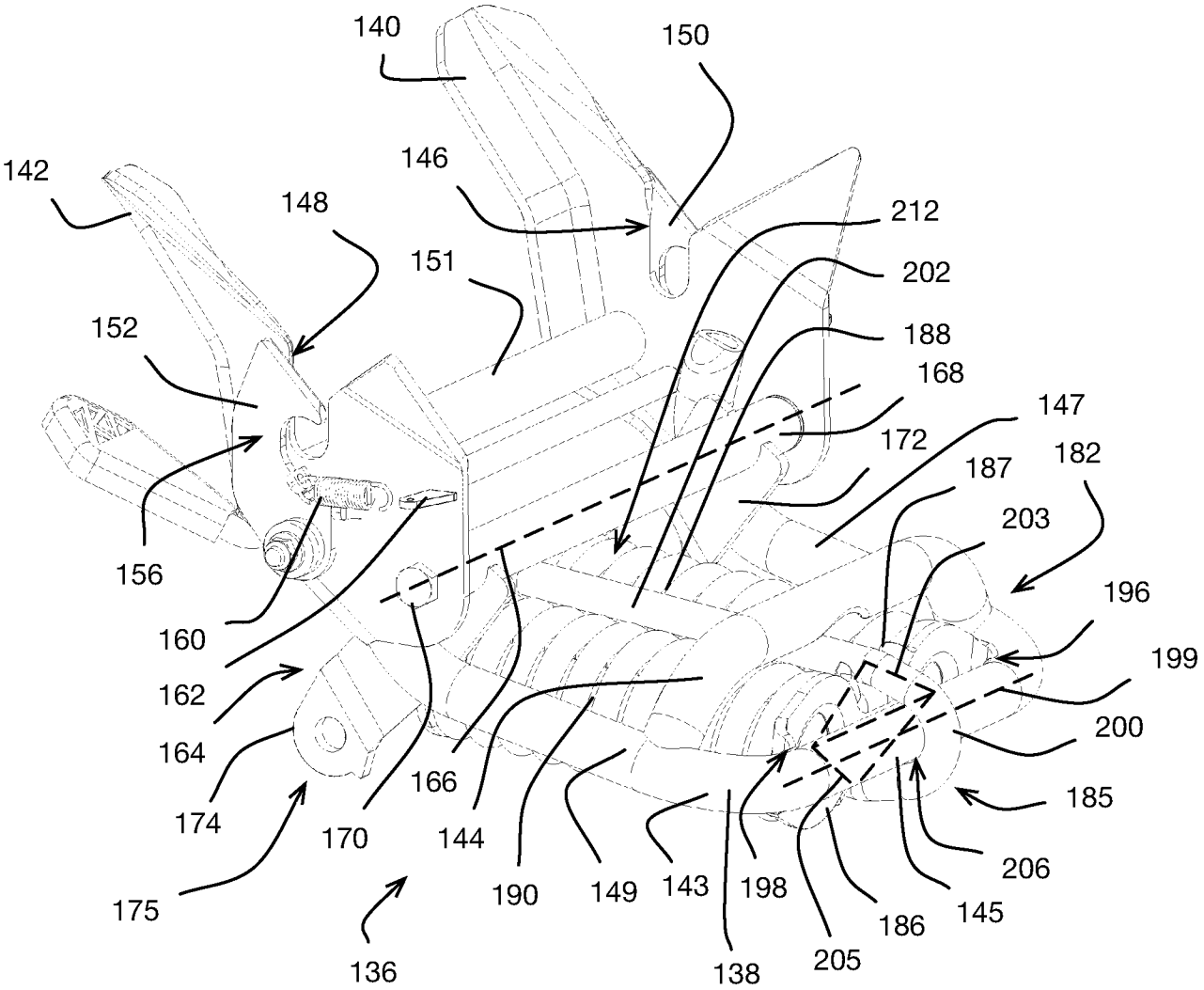
FIG. 8 is a perspective view taken from a rear, top, left side of the frame assembly of FIG. 3.

As best shown in FIGS. 7 and 8, the generally u-shaped frame member 143 includes a transverse abutment frame member 145 and two side portions 147, 149 extending generally forward from the transverse abutment frame member 145. The abutment member 144 is welded at each of its ends to the frame member 143 at locations on the generally u-shaped frame member 143 that are positioned forward of the transverse abutment frame member 145 of the generally u-shaped frame member 143. In this implementation, the abutment member 144 is generally u-shaped and extends upward from the generally u-shaped frame member 143. As will be described in more detail herein below, the receiving members 140, 142 and the abutment member 144 provide surfaces that contact the receiving assembly 120 when the frame assembly 136 is removably attached to the receiving assembly 120 and thereby help lock the frame assembly 136 relative to the receiving assembly 120.

In this implementation, and as best shown in FIG. 8, the receiving member 140 is welded to an end of the side portion 147 of the generally u-shaped frame member 143. Similarly, the receiving member 142 is welded to an end of the side portion 149 of the generally u-shaped frame member 143 in the same way as the receiving member 140 is welded to the end of the side portion 147. Also in this implementation, a support frame member 151 is transversely positioned between the two receiving members 140, 142 and is welded at each of its ends to one of the two receiving members 140, 142 to provide additional strength to the support frame 138. It is contemplated that different interconnections between the various components of the support frame 138 could be used.

Figure 6:
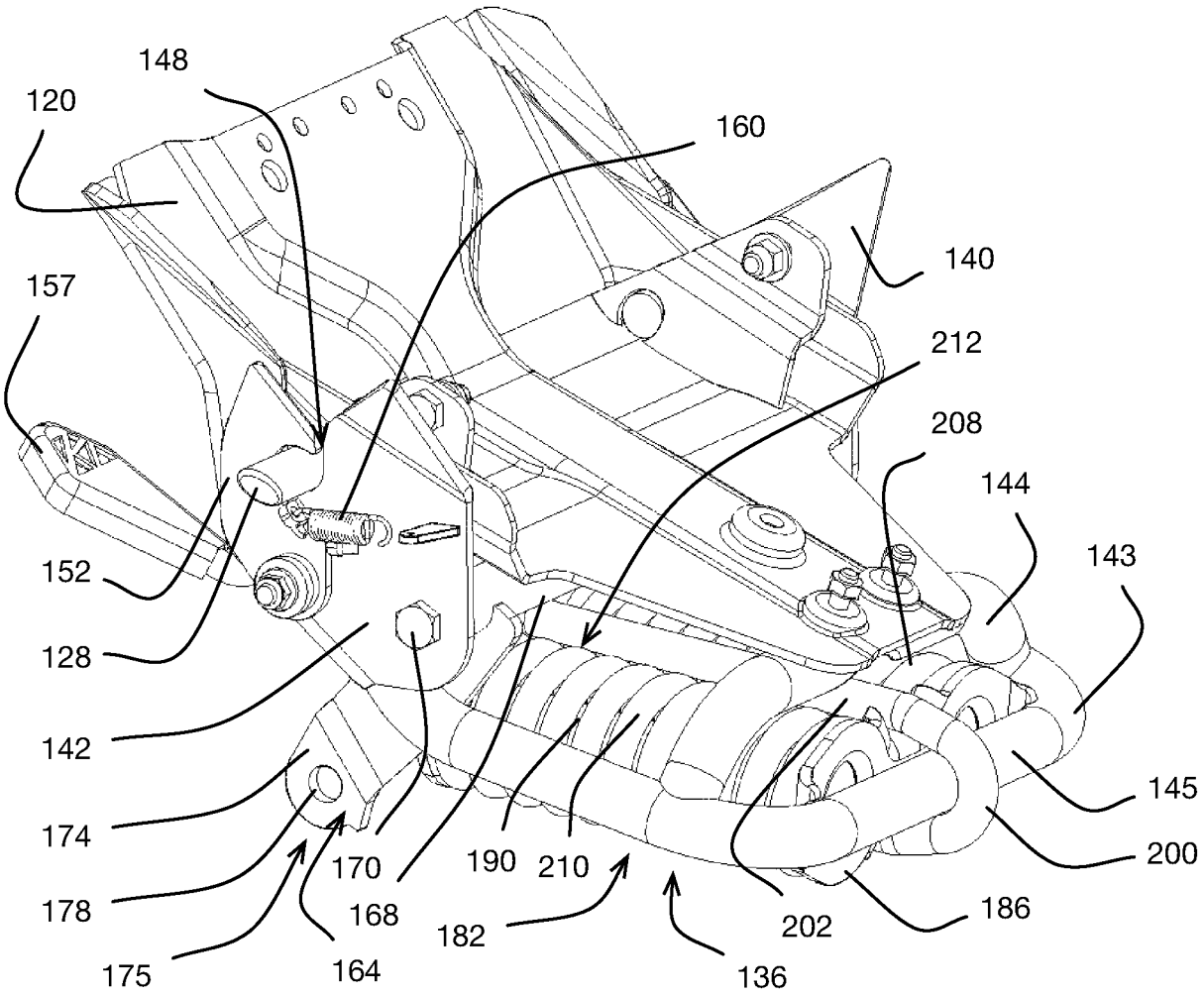
FIG. 6 is a perspective view taken from a rear, top, left side of the frame assembly and the receiving assembly of FIG. 3.

As best shown in FIG. 8, each of the receiving members 140 and 142 defines a cavity 146, 148 therein, respectively. The cavity 146 of the receiving member 140 is open on a top side of the receiving member 140 and is sized to releasably receive the rod 128 of the ATV 100 therein via the top side of the receiving member 140, as shown in FIG. 6 for example, for removably attaching the support frame 138 to the receiving assembly 120. Similarly, the cavity 148 of the receiving member 142 is open on a top side of the receiving member 142 and is sized to releasably receive the rod 128 of the ATV 100 therein via the top side of the receiving member 140, for removably attaching the support frame 138 to the receiving assembly 120. In this implementation, the receiving member 140 is a mirror image of the receiving member 142, but need not be.

Figure 5:
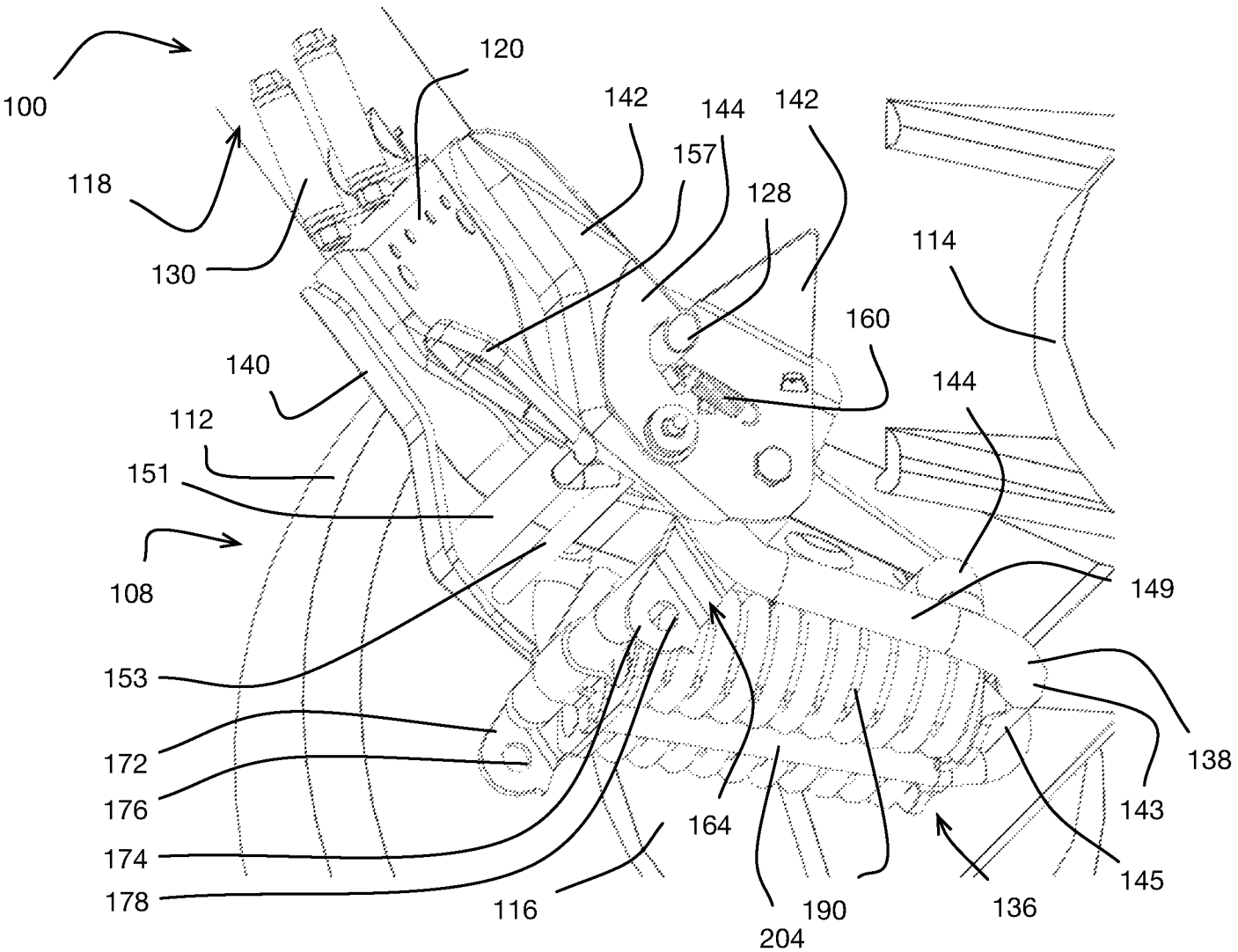
FIG. 5 is a perspective view of the part of the ATV of FIG. 4, taken from a front, bottom, left side of the ATV, with the snow plow and snow plow frame being removed for clarity.

Still referring to FIG. 8, the frame assembly 136 further includes two retaining members 150, 152 that are pivotably attached to corresponding ones of the two receiving members 140, 142. As best shown in FIG. 5, in this implementation, the retaining members 150, 152 are mounted to corresponding ones of the ends of a rod 153 that is received transversely through apertures defined in the receiving members 140, 142. The rod 153 pivots relative to the receiving members 140, 142, and the retaining members 150, 152 pivot with the rod 153. It is contemplated that any other suitable pivot connection could be used.

Similar to the receiving members 140, 142, the retaining members 150, 152 are mirror images of each other, but need not be. Each of the two retaining members 150, 152 is movable relative to its corresponding receiving member 140, 142 between an unlocked position 154, shown in FIG. 3, in which the retaining member 150, 152 does not obstruct its respective cavity 146, 148 and thereby allows the rod 128 to be received in the respective cavity 146, 148, and a locked position 156, shown in FIG. 4, in which the retaining member 150, 152 obstructs its respective cavity 146, 148 on the top side of the receiving member 140, 142 and thereby prevents the rod 128 from exiting the respective cavity 146, 148 via the top side of the receiving member 140, 142 after the rod 128 has been received in the respective cavity 146, 148.

In this implementation, the retaining member 152 is biased from the unlocked position 154 to the locked position 156 with a spring 160 connected at one end to the retaining member 152 and at the other end to a flange 162 protruding from the receiving member 142. (The figures show the other end of the spring 160 being disconnected from the flange 162 to better show the flange 162.) The retaining member 150 is biased from the unlocked position 154 to the locked position 156 in the same way as the retaining member 152, and therefore the biasing spring of the retaining member 150 and the flange extending from the receiving member 140 are not described herein in any more detail. It is contemplated that the retaining members 150, 152 could be biased to the locked position 156 via any other suitable means.

To removably attach the frame assembly 136 to the receiving assembly 120, the rod 128 is aligned with the cavities 146, 148 and the frame assembly 136 is pushed upward against the rod 128, until the rod 128 pushes the retaining members 150, 152 from the locked position 156 toward the unlocked position 154 and snap fits into the cavities 146, 148. Once the rod 128 snap fits into the cavities 146, 148, the retaining members 150, 152 return to their locked position 156 and thereby lock the rod 128 in the cavities 146, 148 and the frame assembly 136 on the receiving assembly 120. When the rod 128 is locked in the cavities 146, 148, the receiving members 140, 142 and the abutment member 144 contact the receiving assembly 120 and thereby prevent the support frame 138 from pivoting about the rod 128.

For detaching the frame assembly 136 from the receiving assembly 120, a release handle 157 is provided. As best shown in FIG. 5, the release handle 157 is welded to the rod 153 and pivots the rod 153 when pressed to move the retaining members 150, 152 from their locked position 156 to their unlocked position 154. It is contemplated that a different release mechanism could be used. Also, while in this implementation the support frame 138 has the particular mounting mechanism described herein above for removably attaching the support frame 138 to the receiving assembly 120, it is contemplated that in some implementations the support frame 138 could have a different suitable mounting mechanism via which the support frame 138 could removably attach to the ATV 100.

As best shown in FIGS. 6 to 8, the frame assembly 136 further includes a lever 164 that is pivotably connected to the support frame 138 to pivot about a lever pivot axis 166. In this implementation, the lever 164 includes a pivoting frame member 168 that is transversely positioned between the two receiving members 140, 142 and is pivotably supported on a rod 170 received coaxially through the pivoting frame member 168 and the receiving members 140, 142, and secured at each end thereof to one of the receiving members 140, 142. It is contemplated that any other pivot connection could be used.

The lever 164 further includes two brackets 172, 174 that are generally parallel to each other and generally orthogonal to the pivoting frame member 168. Each of the brackets 172, 174 extends downward and forward from the pivoting frame member 168 when the lever 164 is positioned in the angular position 175 shown in FIGS. 5 to 8, relative to the support frame 138 and the lever pivot axis 166.

The bracket 172 defines an aperture 176 transversely through its end portion. Similarly, the bracket 174 defines an aperture 178 transversely through its end portion. Each of the apertures 176, 178 is sized to receive a pin 179 (FIG. 2) of the snow plow frame 103 therein, to pivotably attach the snow plow frame 103 the bracket 172, 174 having that aperture 176, 178. FIGS. 2 to 4 show the snow plow 101 being connected to the brackets 172, 174 of the frame assembly 136 via the snow plow frame 103, the snow plow frame 103 being pivotably connected to the brackets 172, 174 via the pins 179 of the snow plow frame 103. The right side pin of the snow plow frame 103 is a mirror image of the left side pin 179 of the snow plow frame 103. Therefore, only the left side pin 179 is shown.

In this implementation, and as best shown in FIG. 4, the snow plow frame 103, and therefore the snow plow 101, is connected to the brackets 172, 174 to pivot about the implement frame pivot axis 177. In this implementation, and as best shown in FIG. 7, the implement frame pivot axis 177 passes through the center of each of the apertures 176, 178 and is parallel to the lever pivot axis 166. As shown schematically in FIG. 7, the implement frame pivot axis 177 is spaced from the lever pivot axis 166 by a distance 173, measured normal to the lever pivot axis 166.

As described herein above, the implement frame pivot axis 177 allows the snow plow 101 and the snow plow frame 103 to pivot upward 96 and downward 98 relative to flat horizontal level ground 183 when the frame assembly 136 is in use. This may be done by an operator of the ATV 100 to lower the snow plow 101 to the ground 183 such that a bottom edge 191 of the snow plow 101 would contact the ground 183 for plowing snow and to raise the snow plow 101 above the ground 183 for driving without plowing snow.

Figure 12:
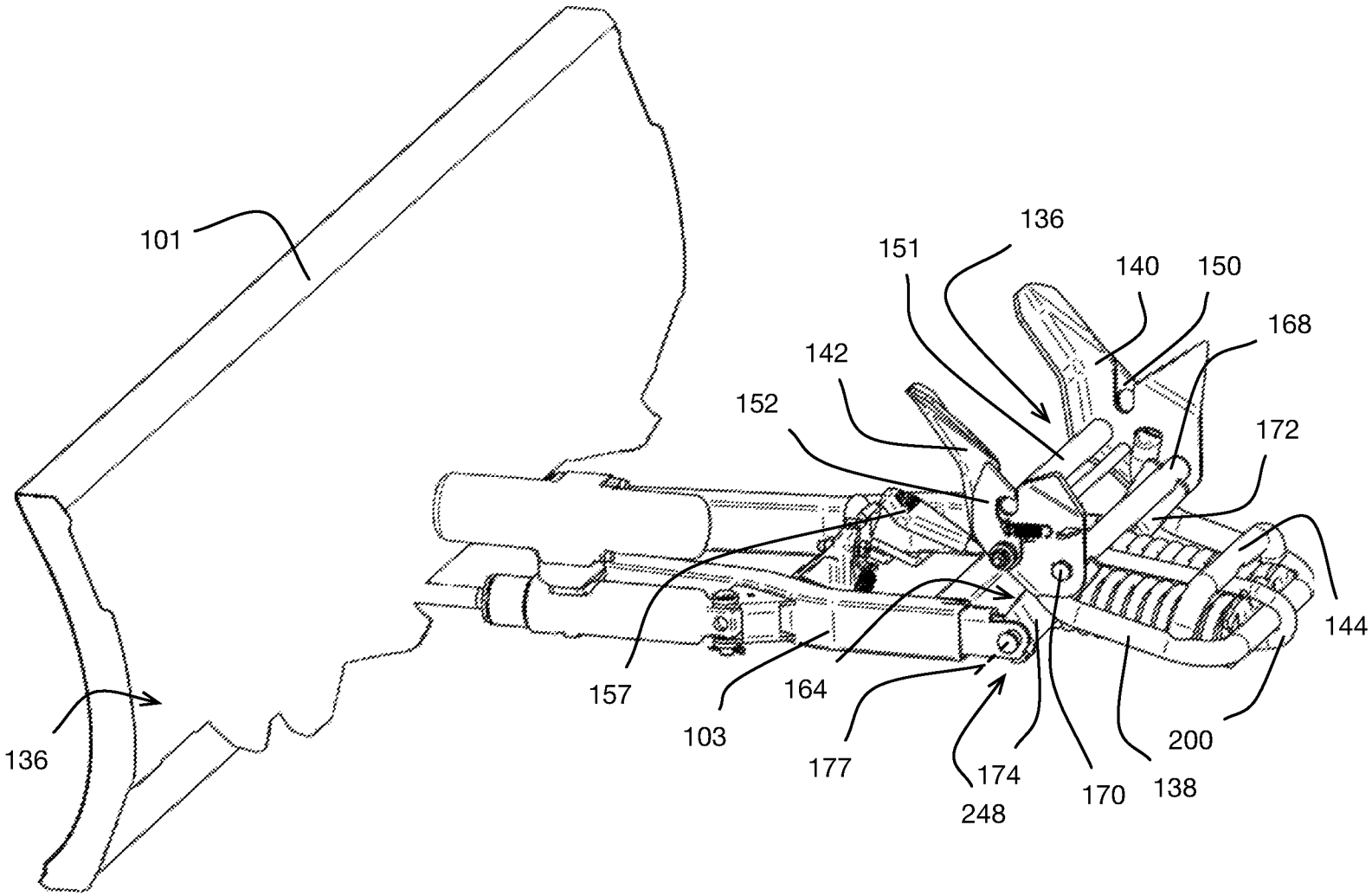
FIG. 12 is a perspective view of the snow plow, the snow plow frame, and the frame assembly of FIG. 2, the lever and the biasing assembly of the frame assembly being in the first state.
Figure 13:
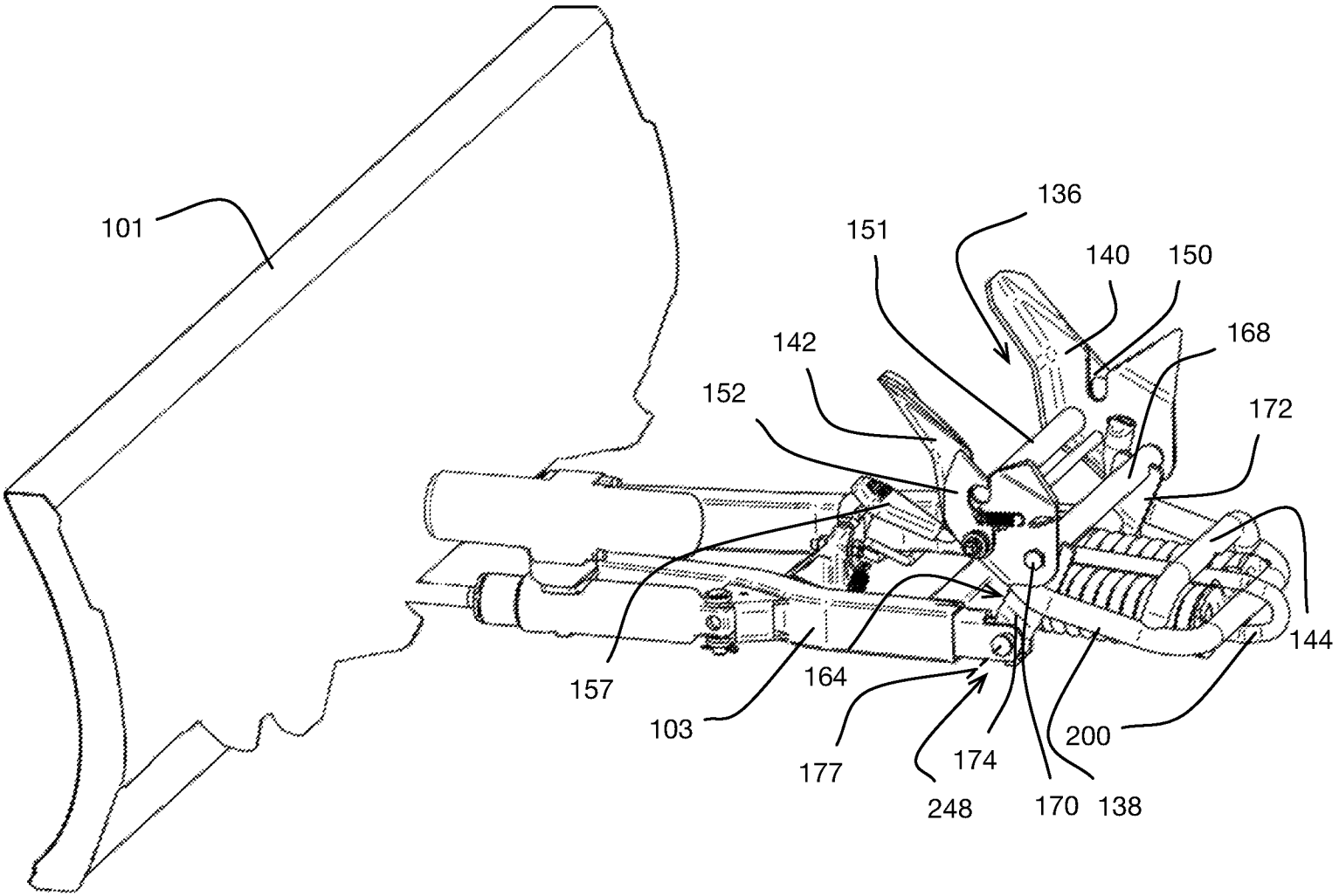
FIG. 13 is a perspective view of the snow plow, the snow plow frame, and the frame assembly of FIG. 2, the lever and the biasing assembly of the frame assembly being in the second state.
Figure 14:
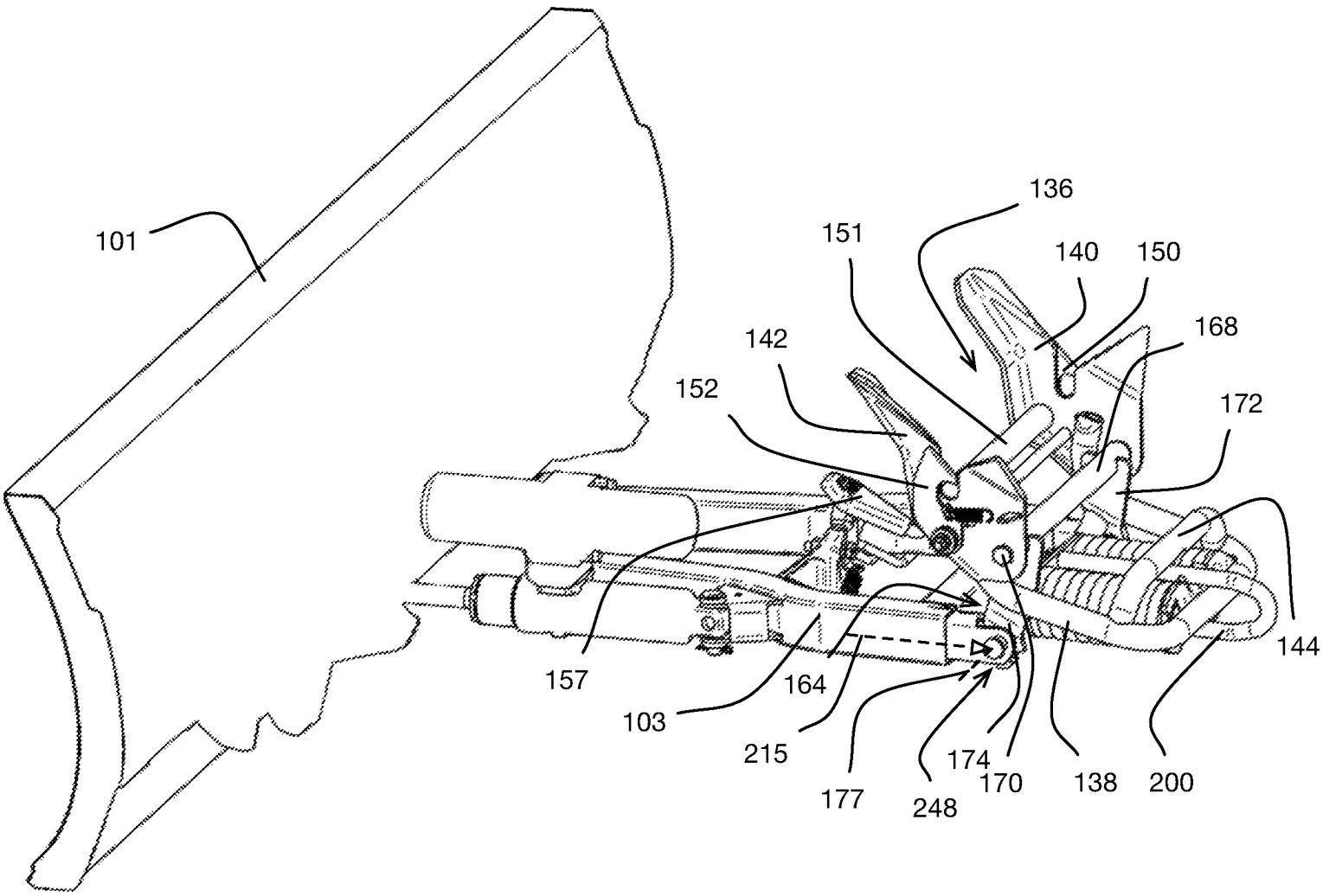
FIG. 14 is a perspective view of the snow plow, the snow plow frame, and the frame assembly of FIG. 2, the lever and the biasing assembly of the frame assembly being in the third state.

It is contemplated that the brackets 172, 174 could be structured for a different type of connection to the snow plow 101 and/or the snow plow frame 103 and/or other implement and/or other implement support frame, and could be different members such as tubular members for example. That is, as shown in FIGS. 12 to 14 for example, the brackets 172, 174 define an attachment portion 248 for the snow plow 101 (via the snow plow frame 103), and it is contemplated that the attachment portion for the snow plow 101 (via the snow plow frame 103) could be structured to fixedly, instead of pivotably, connect to the snow plow frame 103. In some such implementations, the implement frame pivot axis 177 could be defined by the snow plow frame 103 in the snow plow frame 103, at a location that is between the snow plow 101 and the connection between the lever 164 and the snow plow frame 103.

In the present implementation, and as best shown in FIG. 7, the frame assembly 136 further includes a biasing assembly support frame member 180. As described in more detail herein below, the biasing assembly support frame member 180 supports a biasing assembly 182 thereon, which biasing assembly 182 biases a bottom end of the lever 164 forward, as shown with reference arrow 181 in FIG. 10, and absorbs rearward forces 215 that may be applied to the lever 164 by the snow plow 101 when the snow plow 101 is in use.

As best shown in FIG. 7, in the present implementation, the biasing assembly support frame member 180 is positioned transversely between the brackets 172, 174, intermediate the pivoting frame member 168 and the apertures 176, 178 and is welded at each of its ends to a corresponding one of the brackets 172, 174. It is contemplated that a different connection could be used to connect the biasing assembly support frame member 180 to the lever 164. As best seen in FIG. 7, the biasing assembly support frame member 180 is positioned downward and forward of the pivoting frame member 168 when the lever 164 is in the angular position 175.

As shown in FIG. 7, the biasing assembly support frame member 180 is spaced from the lever pivot axis 166 by a distance 181, measured normal to the lever pivot axis 166. In the present implementation the distance 173 is larger than the distance 181, and the attachment portion for the snow plow 101 defined by the brackets 172, 174 is at a lower elevation than the transverse abutment frame member 145 when the support frame 138 is removably attached to the ATV 100 as described herein above and the lever 164 is in the angular position 175. In an aspect, this provides a lever effect with regard to transfer of rearward forces 215 from the snow plow 101 to the biasing assembly 182 and to the transverse abutment frame member 145 when the snow plow 101 is in use and is hit against an obstacle for example.

Figure 9:
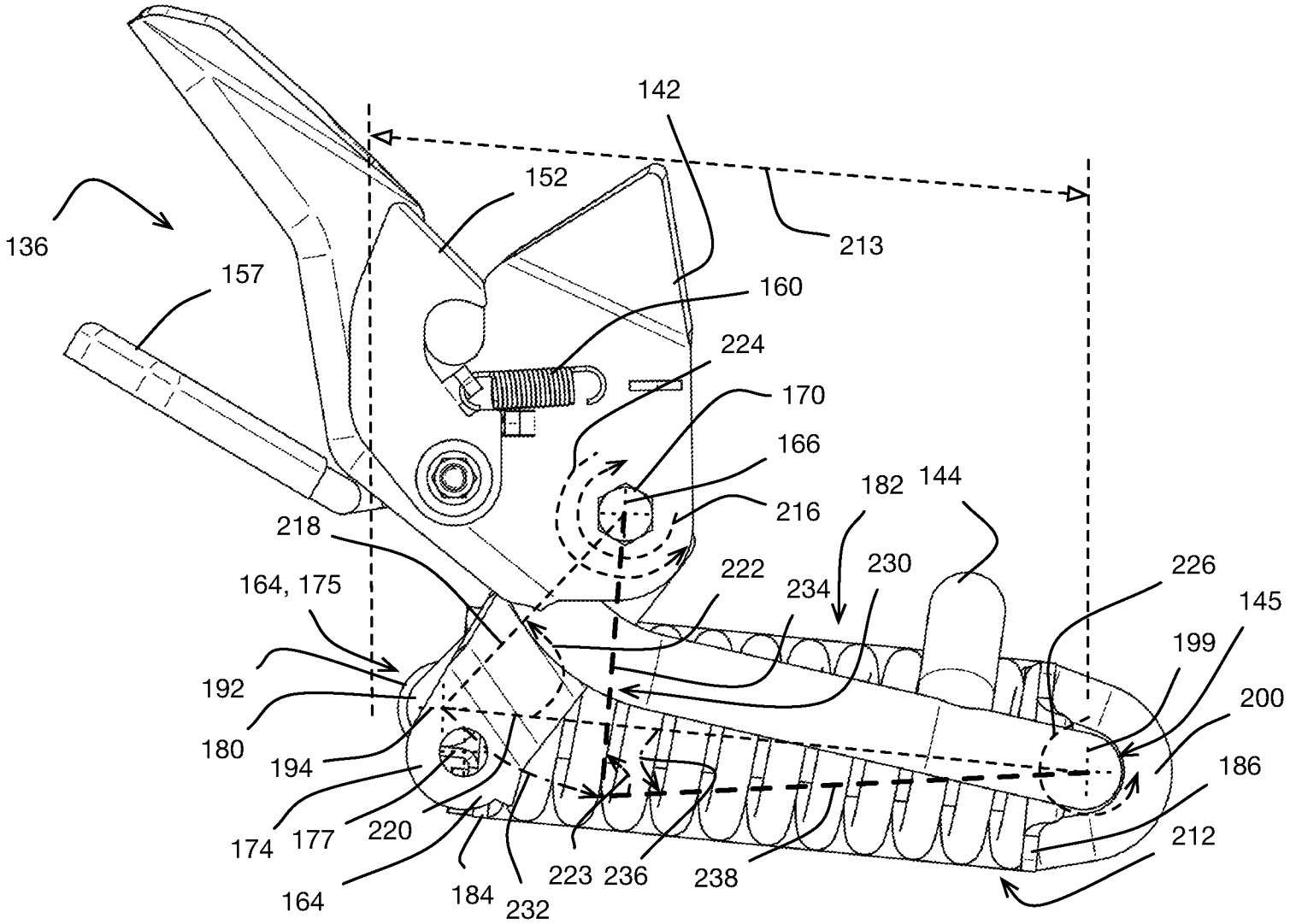
FIG. 9 is a left side elevation view of the frame assembly of FIG. 3, the frame assembly having a lever and a biasing assembly, the lever and the biasing assembly being in a first state.

It is contemplated that the distance 181 could be selected different relative to the distance 173, depending on the application of frame assembly 136 for example. In some implementations, the distances 173, 181 are equal. In some implementations, the distance 173 is smaller than the distance 181. Also, as best shown in FIG. 9, in the present implementation, when the support frame 138 is removably attached to the ATV 100 as described herein above and the lever 164 is in the angular position 175, the attachment portion for the snow plow 101 defined by the brackets 172, 174 is rearward of the biasing assembly support frame member 180. In some other implementations of the frame assembly 136, this is not the case.

The biasing assembly 182 is supported on the biasing assembly support frame member 180 and the transverse abutment frame member 145. To this end, the biasing assembly support frame member 180 defines an attachment portion for a front end of the biasing assembly 182, and the transverse abutment frame member 145 defines an attachment portion for a rear end of the biasing assembly 182.

As best shown in FIGS. 6 to 8, in the present implementation the biasing assembly 182 includes a front compression plate 184, a rear compression plate 186, two telescoping guide rods 188, 190 (FIG. 8) extending between the front and rear compression plates 184, 186 and a limiting member 185. The guide rods 188, 190 are conventionally known. The guide rod 188 is the same as the guide rod 190, but does not need to be. Each of the guide rods 188, 190 is connected at each of its ends to a corresponding one of the front and rear compression plates 184, 186 such that the guide rods 188, 190 are parallel to each other and such that the front and rear compression plates 184, 186 are movable toward each other and away from each other via retraction and extension of the guide rods 188, 190, respectively.

Now referring to FIGS. 7 and 9, the front compression plate 184, and therefore the front end of the biasing assembly 182, is connected to the biasing assembly support frame member 180 via a bracket 192 to pivot about a front biasing assembly pivot axis 194. In this implementation, the implement frame pivot axis 177 is at a lower elevation than the front biasing assembly pivot axis 194 when the support frame 138 is removably attached to the ATV 100 as described herein above and the lever 164 is in the angular position 175. It is contemplated that a different pivot connection, or a different movable connection could be used to connect the front end of the biasing assembly 182 to the lever 164 to receive rearward forces 215 from the snow plow frame 103.

The rear compression plate 186 of the biasing assembly 182 abuts the transverse abutment frame member 145 of the support frame 138 to receive a corresponding reactive force from the support frame 138 when a rearward force 215 is applied to the lever 164 to compress the biasing assembly 182 against the transverse abutment frame member 145. In the present implementation, the rear compression plate 186 defines a pair of abutment surfaces 196, 198 that are shaped to conform to an outer surface of the abutment frame member 145 and thereby help keep the rear compression plate 186 on the transverse abutment frame member 145 when the frame assembly 136 is in use. It is contemplated that a different number of the abutment surfaces 196, 198 could be used. It is also contemplated that the rear compression plate 186 could be connected to the transverse abutment frame member 145 instead of, or in addition to, having the abutment surfaces 196, 198.

Figure 10:
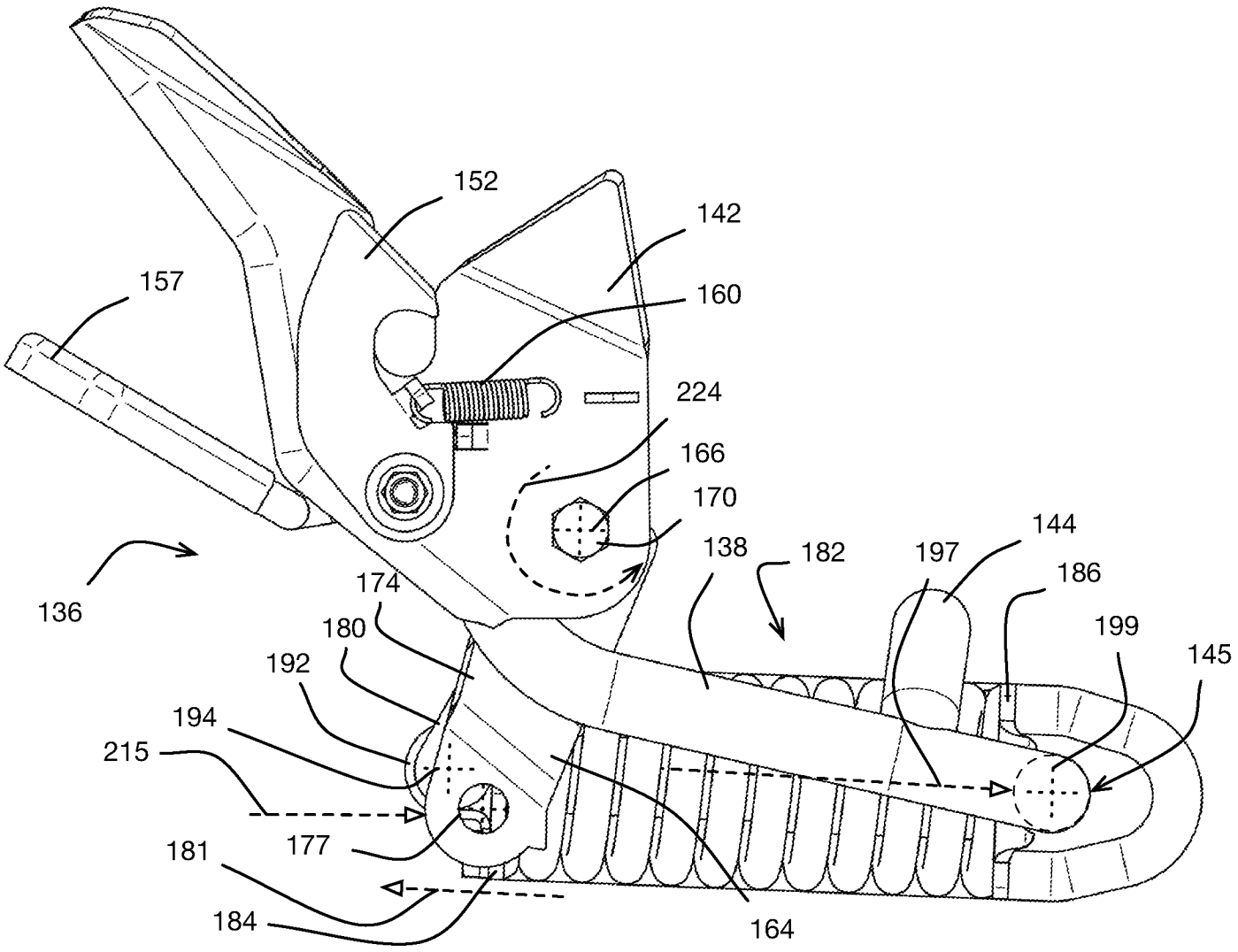
FIG. 10 is a left side elevation view of the frame assembly of FIG. 9, the lever and the biasing assembly being in a second state.

As shown in FIG. 10, when a rearward force 215 is applied to the lever 164 that compresses the biasing assembly 182 and correspondingly pivots the lever 164 about the lever pivot axis 166, the biasing assembly 182 pushes the rear compression plate 186 against the transverse abutment frame member 145, as shown with reference arrow 197. This, in combination with the abutment surfaces 196, 198, supports the rear compression plate 186, and therefore also the rear end of the biasing assembly 182, on the transverse abutment frame member 145 and allows the biasing assembly 182 to pivot about a rear biasing assembly pivot axis 199 as the lever 164 pivots about the lever pivot axis 166.

As shown, the rear biasing assembly pivot axis 199 is parallel to the lever pivot axis 166. Also as shown, in the present implementation, the lever pivot axis 166 is at a higher elevation than the rear biasing assembly pivot axis 199 when the support frame 138 is removably attached to the ATV 100, and more particularly to the receiving assembly 120 in this implementation, and the lever 164 is in the angular position 175. In some applications, this allows the frame assembly 136 to be made relatively more compact and/or to be structured to be closer to some parts of the ATV 100 when removably attached to the ATV 100.

As best shown in FIGS. 5 to 8, in the present implementation, the limiting member 185 is defined by a u-shaped structure 200 and two longitudinal members 202, 204 extending from the u-shaped structure 200. As best shown in FIG. 7, the longitudinal member 202 is connected at its end to the front compression plate 184 and the bracket 192 via a bolt 193 received through the bracket 192, the front compression plate 184 and in a threaded aperture defined in the end of the longitudinal member 202. Similarly, as best shown in FIG. 7, the longitudinal member 204 is connected at its end to the front compression plate 184 and the bracket 192 via a bolt 195 received through the bracket 192, the front compression plate 184 and in a threaded aperture defined in the end of the longitudinal member 204. The bolts 193, 195 can be threaded further into corresponding ones of the longitudinal members 202, 204 to decrease a length of the limiting member 185, and unthreaded from corresponding ones of the longitudinal members 202, 204 to increase the length of the limiting member 185. It is contemplated that a different length adjustment mechanism could be used.

As best shown in FIGS. 8 to 11, the limiting member 185 straddles the rear compression plate 186 such that the rear compression plate 186 can slide along the longitudinal members 202, 204. To this end, the rear compression plate 186 defines a seat 187 in a top side thereof, and a seat 189 on a bottom side thereof. The longitudinal member 202 is received in and is slidable along the seat 187. The longitudinal member 204 is received in and is slidable along the seat 189. As shown in FIG. 8, in this implementation, the longitudinal member 202 forms a notional isosceles triangle 203 with the guide rods 188, 190 (FIG. 8) in a transverse plane, with the longitudinal member 202 being at an apex of the isosceles triangle 203, the apex of the isosceles triangle 203 pointing upward. Similarly in this implementation, the longitudinal member 204 forms a notional isosceles triangle 205 with the guide rods 188, 190 in a transverse plane, the longitudinal member 204 being at an apex of the isosceles triangle 205, the apex of the isosceles triangle 205 pointing downward.

As best shown in FIG. 8, the limiting member 185 defines an aperture 206 between the rear compression plate 186 and the u-shaped structure 200. The transverse abutment frame member 145 is received through the aperture 206. When the lever 164 is in the angular position 175, the u-shaped structure 200 of the limiting member 185 contacts the transverse abutment frame member 145 and thereby defines a distance by which the front and rear compression plates 184, 186 can move away from each other before this movement is stopped by the limiting member 185.

As best shown in FIGS. 6 to 8, the biasing assembly 182 includes two springs 208, 210 that bias the front and rear compression plates 184, 186 away from each other. To this end, the springs 208, 210 are mounted over corresponding ones of the guide rods 188, 190 (FIG. 8) and are disposed between the front and rear compression plates 184, 186. In this implementation, each of the springs 208, 210 is compressed beyond its resting position and applies forces in opposite directions to the front and rear compression plates 184, 186. This pushes the front and rear compression plates 184, 186 away from each other. In this implementation, these forces push the front and rear compression plates 184, 186 against the biasing assembly support frame member 180 and the transverse abutment frame member 145, respectively.

These forces, applied by each of the springs 208, 210, are further referred to as the preload of each of the springs. In this implementation, the spring 208 is the same as the spring 210, and the preload of the spring 208 is equal to the preload of the spring 210. Together, the springs 208, 210 provide a preload of the biasing assembly 182 when the lever 164 is in the angular position 175, in which angular position 175 the biasing assembly 182 is in an extended position 212 (FIGS. 6 to 9 for example). The preload of the biasing assembly 182 biases the biasing assembly 182 from a compressed position 214, shown in FIG. 11, to the extended position 212 and pivots the lever 164 to the angular position 175 when no force is applied to the lever 164 that would overcome the preload of the biasing assembly 182.

In other words, the biasing assembly 182 is in the extended position 212 when the lever is in the angular position 175 and in this position pushes the front and rear compression plates 184, 186 away from each other. If the biasing assembly 182 were to be removed from the frame assembly 136, the biasing assembly 182 would extend beyond extended position 212 to another extended position 213, shown schematically in FIG. 9. As schematically shown in FIG. 9, in the extended position 213, the biasing assembly 182 has a greater length than in the extended position 212. As described in more detail herein below, the length of the limiting member 185 is selected such that the limiting member 185 prevents the biasing assembly 182 from extending beyond the extended position 212 toward the extended position 213. The length of the limiting member 185 thereby defines the angular position 175 of the lever 164 relative to the support frame 138.

It is contemplated that the biasing assembly 182 could have a single spring, or a greater number of springs than the two springs 208, 210. It is contemplated that different biasing members and shock absorbers could be used in addition to, instead of, or in combination with the springs 208, 210. For example, it is contemplated that the guide rods 188, 190 could be replaced with corresponding hydraulic shock absorbers to add damping to movement of the springs 208, 210 for example.

Operation of the frame assembly 136 will now be described in more detail with reference to FIGS. 9 to 14. The preload of the biasing assembly 182 applies a force to the lever 164 tending to pivot the lever clockwise 216, when the frame assembly 136 is viewed from its left side about the lever pivot axis 166, as shown in FIG. 9. The length of the limiting member 185 is selected, for example by selecting a length of the longitudinal members 202, 204 and/or adjusting the extend to which the bolts 193, 195 are threaded into the respective longitudinal members 202, 204, such that when the lever 164 pivots clockwise 216 about the lever pivot axis 166 and reaches the angular position 175, the u-shaped structure 200 contacts the transverse abutment frame member 145 and thereby prevents further extension of the biasing assembly 182 and stops the lever 164 from pivoting clockwise 216 past the angular position 175.

It is contemplated that the biasing assembly 182 could be, for example, mirrored about a transverse reference plane such that the u-shaped structure 200 would interact with the biasing assembly support frame member 180 to limit extension of the biasing assembly 182, instead of interacting with the transverse abutment frame member 145 and thereby limiting extension of the biasing assembly 182 as described herein above. In some such implementations, the front compression plate 184 would be connected to the transverse abutment frame member 145 to pivot about the rear biasing assembly pivot axis 199, for example via the bracket 192, the rear compression plate 186 could abut the biasing assembly support frame member 180 to pivot about the front biasing assembly pivot axis 194, and the biasing assembly support frame member 180 could be received in the aperture 206 defined between the u-shaped structure 200 and the rear compression plate 186. It is contemplated that other limiting assemblies could be used instead of or in addition to the limiting member 185. It is also contemplated that other biasing assemblies could be used instead of or in addition to the biasing assembly 182.

Figure 11:
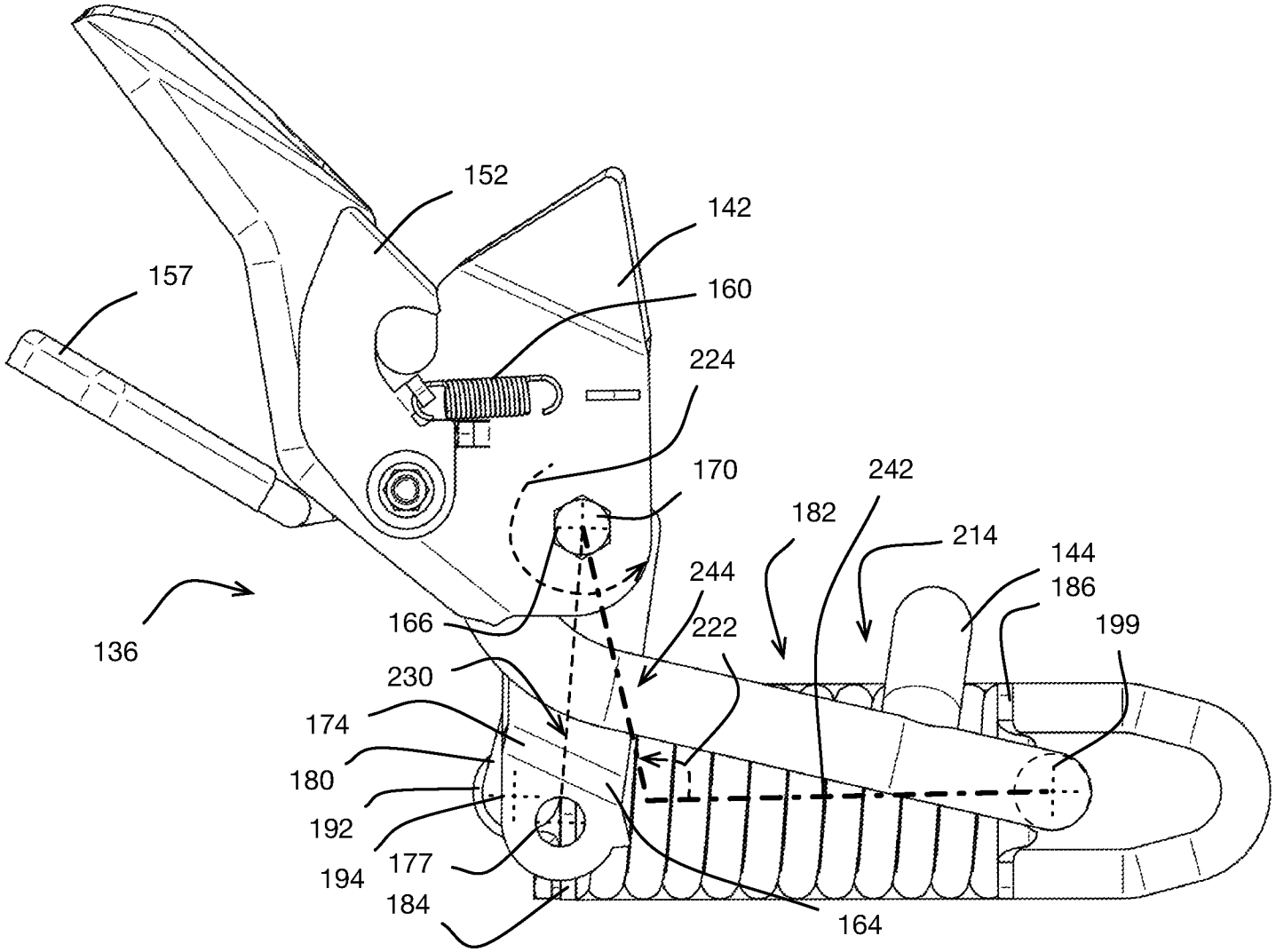
FIG. 11 is a left side elevation view of the frame assembly of FIG. 9, the lever and the biasing assembly being in a third state.

As shown in FIG. 9, the lever pivot axis 166 and the front biasing assembly pivot axis 194 define a first plane 218. Also as shown, the front biasing assembly pivot axis 194 and the rear biasing assembly pivot axis 199 define a second plane 220. The first plane 218 and the second plane 220 define an angle 222 therebetween. As best illustrated by FIGS. 9 to 11, the angle 222 changes as the biasing assembly 182 moves between the extended position 212 and the compressed position 214. As shown in FIG. 9, when the lever 164, and therefore also the biasing assembly support frame member 180, is in the angular position 175 and the frame assembly 136 is removably attached to the receiving assembly 120 as described herein above, the angle 222 is acute and opens toward the ATV 100.

Accordingly, when the lever 164 pivots counter-clockwise 224 about the lever pivot axis 166 from the angular position 175, the biasing assembly 182 pivots counter-clockwise 226 about the rear biasing assembly pivot axis 199 and the front end of the biasing assembly 182 moves downward. Movement of the lever 164 from the angular position 175 to an angular position 230 is shown with arrow 232 in FIG. 9. Corresponding movement of the biasing assembly 182 is shown with arrow 236 and reference line 238. Reference line 234 schematically shows the lever 164 being in the angular position 230. Reference line 238 schematically shows a state of compression and an angular position of the biasing assembly 182 corresponding to the angular position 230 of the lever 164.

In some applications, movement 232 of the front end of the biasing assembly 182 downward (i.e. movement 232 that has a downward movement component and no upward movement component), as opposed to upward for example, allows for some parts of the frame assembly 136 that are above or extend above the biasing assembly 182 to be positioned close to the biasing assembly 182 and/or close to each other above the biasing assembly 182 because when the frame assembly 136 is in use the front end of the biasing assembly 182 does not move upward beyond its position corresponding to the angular position 175 of the lever 164. For some applications, this allows the frame assembly 136 to relatively compact.

In the present implementation, the springs 208, 210 are selected to provide 500 pounds (226.8 kilograms) of preload when the lever 164 is in the angular position 175, and to provide 1.5 inches (38.1 millimeters) of travel 240 when the biasing assembly 182 moves from the extended position 212 to the compressed position 214. It is contemplated that the springs 208, 210 could be selected to provide a different travel during this movement of the biasing assembly 182, depending on the particular vehicle that a particular implementation of the frame assembly 136 is designed for, for example. In the present implementation, the compressed position 214 defines a compression limit of the springs 208, 210 beyond which the springs 208, 210, and the biasing assembly 182, cannot compress. As schematically shown in FIG. 9, the springs 208, 210 are selected such that when the biasing assembly 182 is in the compressed position 214, the angle 222 is acute. The angle 222 corresponding to the compressed position 214 is schematically shown as angle 223 in FIG. 9.

As shown schematically in FIG. 11, in other implementations, the springs 208, 210 are selected and the support frame 138 is dimensioned such that the biasing assembly 182 is movable to a compressed position 242 in which the biasing assembly 182 is more compressed than in the compressed position 214, and such that when the biasing assembly 182 is in the compressed position 242, the angle 222 is obtuse and faces toward the ATV 100. In some such implementations, the compressed position 242 defines the compression limit of the springs 208, 210 instead of the compressed position 214, and accordingly the length of the biasing assembly 182 in the compressed position 242 is shorter the length of the biasing assembly 182 in the compressed position 214. As shown schematically in FIG. 11, in such implementations, the lever 164 pivots counter-clockwise 224 about the lever pivot axis 166 past the angular position 230 to an angular position 244. As shown, the angular position 244 is rearward of the angular position 230.

Movement of the lever 164 could be described with regard to movement of a clock hand about a clock face, with the lever pivot axis 166 passing through the origin of rotation of the clock hand. For example, movement of the lever 164 from the angular position 175 to the angular position 244 could be described as movement of the lever 164 from a third quadrant of a reference clock face, defined between six o'clock and nine o'clock on the clock face, to a second quadrant, defined between three o'clock and nine o'clock on the clock face, when the frame assembly 136 is viewed from the left side thereof. In this example, the lever 164 is at nine o'clock when the angle 222 is a right angle.

In an aspect, movement of the lever 164 from the third quadrant to the second quadrant, for example from the angular position 175 to the angular position 244, provides for relatively longer compression of the biasing assembly 182 than movement of the lever 164 within the third quadrant.

In another aspect, such movement of the lever 164 causes the biasing assembly 182 to pivot counter-clockwise 226 about the rear biasing assembly pivot axis 199 while the lever 164 is moving from the angular position 175 to the border between the third and the second quadrants, and clockwise about the rear biasing assembly pivot axis 199 while the lever 164 is moving from the border between the third and the second quadrants to the angular position 244.

In another aspect, in some implementations, the biasing assembly 182 is selected and/or adjusted to define the angular position 244 of the lever 164 relative to the support frame 138 such that the angular position of the biasing assembly 182 that corresponds to the angular position 244 of the lever 164 is the same as an initial angular position of the biasing assembly 182 corresponding to the angular position 175 of the lever 164. In some implementations, the biasing assembly 182 is selected and/or adjusted to define the angular position 244 of the lever 164 relative to the support frame 138 such that the angular position of the biasing assembly 182 that corresponds to the angular position 244 of the lever 164 is counter-clockwise 226 from the initial angular position of the biasing assembly 182. In some applications, this allows to, for example, select the biasing assembly 182 to provide more travel 240, and more force absorption, in comparison to implementations in which the lever 164 is movable only in the third quadrant for example, while preventing the biasing assembly 182 from pivoting clockwise above its initial angular position.

Modifications and improvements to the above-described implementations of the present technology may become apparent to those skilled in the art. The foregoing description is intended to be exemplary rather than limiting.

The invention claimed is:

1. A frame assembly for supporting an implement on a vehicle, comprising:

a) a support frame being structured to be removably attached to the vehicle;

b) a lever being pivotably connected to the support frame to pivot about a first pivot axis between a first position and a second position, the lever including:

i) a first attachment portion, and ii) a second attachment portion being structured to connect to the implement; and c) a biasing assembly having a first end and a second end, the first end and the second end defining a length of the biasing assembly, the biasing assembly being movable between an extended position and a compressed position, the length of the biasing assembly being greater in the extended position than in the compressed position, the biasing assembly being biased from the compressed position toward the extended position, the first end being supported against the first attachment portion to pivot about a second pivot axis, the second pivot axis being parallel to the first pivot axis and being vertically spaced relative to the first pivot axis when the support frame is removably attached to the vehicle and the first attachment portion is in the first position, the second end being supported against the support frame to pivot about a third pivot axis when the first attachment portion pivots about the first pivot axis, the third pivot axis being parallel to the first pivot axis and being spaced from the first pivot axis when the support frame is removably attached to the vehicle;

iii) the first attachment portion being in the first position when the biasing assembly is in the extended position, iv) the first attachment portion being in the second position when the biasing assembly is in the compressed position; and wherein the second attachment portion is at a lower elevation than the first attachment portion when the support frame is removably attached to the vehicle and the first attachment portion is in the first position.

2. The frame assembly of claim 1, wherein the second pivot axis is at a higher elevation than the third pivot axis when the support frame is removably attached to the vehicle and the first attachment portion is in the first position.

3. The frame assembly of claim 1, wherein the second pivot axis is forward of the first pivot axis when the support frame is removably attached to the vehicle and the first attachment portion is in the first position.

4. The frame assembly of claim 2, wherein the angle is acute when the biasing assembly is in the compressed position.

5. The frame assembly of claim 4, wherein the compressed position defines a compression limit of the biasing assembly.

6. The frame assembly of claim 4, wherein:

a) the compressed position is a first compressed position;

b) the biasing assembly is movable to a second compressed position in which the length of the biasing assembly is smaller than in the first compressed position;

c) the first attachment portion is pivotable about the first pivot axis from the second position to a third position that is rearward of the second position;

d) the biasing assembly is in the second compressed position when the first attachment portion is in the third position;

e) the biasing assembly is biased from the second compressed position toward the first compressed position; and f) the angle is obtuse and opens toward the vehicle when the support frame is removably attached to the vehicle and the first attachment portion is in the third position.

7. The frame assembly of claim 6, wherein the second compressed position defines a compression limit of the biasing assembly.

8. The frame assembly of claim 1, wherein:

a) the first attachment portion is spaced from the first pivot axis by a first distance, the first distance being measured normal to the first pivot axis;

b) the second attachment portion is spaced from the first pivot axis by a second distance, the second distance being measured normal to the first pivot axis; and c) the second distance is larger than the first distance.

9. The frame assembly of claim 1, wherein the second attachment portion is rearward of the first attachment portion when the support frame is removably attached to the vehicle and the first attachment portion is in the first position.

10. The frame assembly of claim 1, wherein the second attachment portion is structured to connect to the implement to pivotably support the implement on the second attachment portion about a fourth pivot axis, the fourth pivot axis being parallel to the first pivot axis.

11. The frame assembly of claim 10, wherein the fourth pivot axis is at a lower elevation than the second pivot axis when the support frame is removably attached to the vehicle and the first attachment portion is in the first position.

12. The frame assembly of claim 10, wherein the fourth pivot axis is rearward of the second pivot axis when the support frame is removably attached to the vehicle and the first attachment portion is in the first position.

13. The frame assembly of claim 1, wherein the biasing assembly has a preload and the lever is dimensioned and shaped such that when, a) the second attachment portion is connected to the implement, b) the first attachment portion is in the first position, and c) the implement applies a rearward force to the second attachment portion that results in a compression force being applied to the biasing assembly and the compression force exceeds the preload of the biasing assembly, the first end of the biasing assembly pivots downward relative to the third pivot axis.

14. The frame assembly of claim 1, wherein the biasing assembly includes at least one spring extending between the first and second ends of the biasing assembly.

15. The frame assembly of claim 1, further comprising a limiting member defined by a u-shaped structure having two ends, and wherein:

a) the first end of the biasing assembly is connected to the first attachment portion to pivot about the second pivot axis;

b) the two ends of the u-shaped structure are connected to the first end of the biasing assembly;

c) the u-shaped structure slidably straddles the second end of the biasing assembly and defines an aperture between the second end of the biasing assembly and the u-shaped structure;

d) the support frame includes a frame member that is positioned transversely relative to the vehicle when the support frame is removably attached to the vehicle;

e) the frame member is received through the aperture;

f) the extended position of the biasing assembly is a first extended position;

g) the biasing assembly is movable to a second extended position when the biasing assembly is removed from the frame assembly, the length of the biasing assembly being greater than in the second extended position than in the first extended position; and h) a length of the limiting member is selected such that the u-shaped structure contacts the frame member of the support frame when the biasing assembly is in the extended position and thereby prevents the biasing assembly from moving from the first extended position toward the second extended position.

16. The frame assembly of claim 1, further comprising a limiting member defined by a u-shaped structure having two ends, and wherein:

a) the second end of the biasing assembly is connected to the support frame to pivot about the third pivot axis;

b) the two ends of the u-shaped structure are connected to the second end of the biasing assembly;

c) the u-shaped structure slidably straddles the first end of the biasing assembly and defines an aperture between the first end of the biasing assembly and the u-shaped structure;

d) the first attachment portion includes a frame member that is positioned transversely relative to the vehicle when the support frame is removably attached to the vehicle;

e) the frame member is received through the aperture;

f) the extended position of the biasing assembly is a first extended position;

g) the biasing assembly is movable to a second extended position when the biasing assembly is removed from the frame assembly, the length of the biasing assembly being greater than in the second extended position than in the first extended position; and h) a length of the limiting member is selected such that the u-shaped structure contacts the frame member of the first attachment portion when the biasing assembly is in the extended position and thereby prevents the biasing assembly from moving from the first extended position toward the second extended position.

17. The frame assembly of claim 1, wherein the support frame includes:

a) a receiving member defining a cavity therein, the cavity being open on a top side of the receiving member and being sized to releasably receive a rod of the vehicle therein via the top side of the receiving member; and b) a retaining member movable relative to the receiving member between an unlocked position in which the retaining member does not obstruct the cavity and thereby allows the rod to be received in the cavity, and a locked position in which the retaining member obstructs the cavity on the top side of the receiving member and thereby prevents the rod from exiting the cavity via the top side of the receiving member after the rod has been received in the cavity, the retaining member being biased from the unlocked position to the locked position.

* * * * *